US006789393B2

(12) United States Patent
Dais et al.

(10) Patent No.: US 6,789,393 B2
(45) Date of Patent: Sep. 14, 2004

(54) CONTAINER WITH PRESSURE RELIEF AND LID AND METHOD OF MANUFACTURE THEREFOR

(75) Inventors: Brian C. Dais, Howell, MI (US); Joseph Perushek, Brooklyn, WI (US); Kristopher W. Gerulski, Racine, WI (US); Donald E. McCumber, Madison, WI (US); Angela M. Johnson, Sun Prairie, WI (US); Lewis D. Lee, Evansville, WI (US); Peter Schroepfer, Madison, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 112 days.

(21) Appl. No.: 10/313,285

(22) Filed: Dec. 6, 2002

(65) Prior Publication Data

US 2003/0150239 A1 Aug. 14, 2003

Related U.S. Application Data

(63) Continuation-in-part of application No. 10/073,559, filed on Feb. 11, 2002.
(60) Provisional application No. 60/392,728, filed on Jun. 28, 2002.

(51) Int. Cl.[7] ..... F25D 3/08
(52) U.S. Cl. ..... 62/457.6; 62/112
(58) Field of Search ..... 62/457.6, 112, 62/457.3, 371

(56) References Cited

U.S. PATENT DOCUMENTS

| | | | | |
|---|---|---|---|---|
| 893,469 | A | 7/1908 | Essmuller | |
| 1,249,096 | A | 12/1917 | Hulme | |
| 1,519,034 | A | 12/1924 | Livingston | |
| 1,771,186 | A | 7/1930 | Mock | |
| 1,906,815 | A | 5/1933 | Schlumbohm | |
| 2,087,966 | A | 7/1937 | Clark | 62/1 |
| 2,487,400 | A | 11/1949 | Tupper | 150/0.5 |
| 2,507,425 | A | 5/1950 | Swartout | 220/9 |
| 2,526,165 | A | 10/1950 | Smith | 62/1 |
| 2,606,586 | A | 8/1952 | Hill | 150/0.5 |
| 2,622,415 | A | 12/1952 | Landers et al. | 62/142 |
| 2,767,711 | A | 10/1956 | Ernst | 128/249 |
| 2,781,643 | A | 2/1957 | Fairweather | 62/87 |
| 2,800,454 | A | 7/1957 | Shepherd | 252/70 |
| 2,803,115 | A | 8/1957 | Shepherd | 62/1 |

(List continued on next page.)

FOREIGN PATENT DOCUMENTS

| | | | |
|---|---|---|---|
| JP | 55164278 | 12/1980 | |
| JP | 55164279 | 12/1980 | |
| WO | WO 93/24797 | 12/1993 | 3/8 |
| WO | WO 99/32373 | 7/1999 | 81/34 |

OTHER PUBLICATIONS

PCT International Search Report dated Jun. 24, 2003, Appl. No. PCT/US03/03954.

(List continued on next page.)

*Primary Examiner*—Melvin Jones

(57) ABSTRACT

A container comprises a sealed cavity defined by first and second walls of the container and a coolant disposed within the cavity wherein the coolant is capable of assuming first and second phases. A portion of the first wall is joined to the second wall wherein the portion includes an off-center opening. The portion is rupturable to limit pressure in the sealed cavity. The container further comprises a container rim and a lid having both an outer channel and a tab. The outer channel receives the container rim. The outer channel defines a first width. The tab has a second width substantially equal to the first width. When the coolant in the cavity is in the first phase there is a first interference fit of the channel with the container rim. When the coolant is in the second phase, there is a second interference fit, different than the first interference fit, between the container rim and the outer channel of the lid. A method of manufacture of such a container and lid is also disclosed.

39 Claims, 21 Drawing Sheets

U.S. PATENT DOCUMENTS

| | | | | |
|---|---|---|---|---|
| 2,810,276 | A | 10/1957 | Murray | 65/15 |
| 2,849,144 | A | 8/1958 | Southwell | 220/4 |
| 2,863,305 | A | 12/1958 | Shepherd | 62/530 |
| 3,111,240 | A | 11/1963 | Whitton, Jr. | 220/67 |
| 3,130,288 | A | 4/1964 | Monaco et al. | 219/43 |
| 3,141,567 | A | 7/1964 | Scheaerer | 220/24 |
| 3,161,031 | A | 12/1964 | Flannery | 62/457 |
| 3,187,518 | A | 6/1965 | Bair et al. | 62/372 |
| 3,241,706 | A | 3/1966 | Monaco et al. | 220/17 |
| 3,269,144 | A | 8/1966 | Poris | 62/457 |
| 3,286,483 | A | 11/1966 | Burg | 62/371 |
| 3,317,069 | A | 5/1967 | Chin | 215/47 |
| 3,362,565 | A | 1/1968 | McCormick | 220/44 |
| 3,362,575 | A | 1/1968 | Fotos | 220/97 |
| 3,383,880 | A | 5/1968 | Peters | 62/457 |
| 3,384,265 | A | 5/1968 | Frank | 220/97 |
| 3,394,562 | A | 7/1968 | Coleman | 62/457 |
| 3,406,532 | A | 10/1968 | Rownd et al. | 62/457 |
| 3,410,448 | A | 11/1968 | Hudson | 220/42 |
| 3,414,229 | A | 12/1968 | Norberg | 249/121 |
| 3,416,692 | A | 12/1968 | Cline et al. | 220/9 |
| 3,460,711 | A | 8/1969 | Al-Roy | 220/60 |
| 3,460,740 | A | 8/1969 | Hagen | 229/53 |
| 3,516,572 | A | 6/1970 | Davis | 220/60 |
| 3,532,244 | A | 10/1970 | Yates, Jr. | 215/41 |
| 3,545,230 | A | 12/1970 | Morse | 62/530 |
| 3,556,338 | A | 1/1971 | Wilkinson et al. | 220/60 |
| 3,572,413 | A | 3/1971 | Livingstone | 150/0.5 |
| 3,583,596 | A | 6/1971 | Brewer | 220/60 |
| 3,606,074 | A | 9/1971 | Hayes | 220/42 |
| 3,609,263 | A | 9/1971 | Clementi | 220/60 |
| 3,612,342 | A | 10/1971 | Rathbun | 220/60 |
| 3,615,719 | A | 10/1971 | Michel et al. | 220/97 R |
| 3,632,016 | A | 1/1972 | Bozek | 214/6 B |
| 3,670,916 | A | 6/1972 | Alpert | 220/9 F |
| 3,678,703 | A | 7/1972 | Cornish et al. | 62/371 |
| 3,692,208 | A | 9/1972 | Croyle et al. | 220/24.5 |
| 3,702,077 | A | 11/1972 | Szabo | 73/358 |
| 3,715,895 | A | 2/1973 | Devlin | 62/457 |
| 3,722,731 | A | 3/1973 | McCormick et al. | 220/60 |
| 3,732,909 | A | 5/1973 | Rooke et al. | 150/0.5 |
| 3,736,769 | A | 6/1973 | Petersen | 62/530 |
| 3,737,093 | A | 6/1973 | Amberg et al. | 206/14 |
| 3,755,030 | A | 8/1973 | Doman et al. | 156/73 |
| 3,759,415 | A | 9/1973 | Cloyd | 220/60 |
| 3,779,418 | A | 12/1973 | Davis | 220/60 |
| 3,807,194 | A | 4/1974 | Bond | 62/457 |
| 3,817,420 | A | 6/1974 | Heisler | 220/60 |
| 3,859,819 | A | 1/1975 | Kaplan | 62/371 |
| 3,883,036 | A | 5/1975 | Mahaffy et al. | 20/306 |
| 3,899,097 | A | 8/1975 | Aichinger | 215/253 |
| 3,922,879 | A | 12/1975 | Arnold | 62/458 |
| 3,923,237 | A | 12/1975 | Bostrom et al. | 229/43 |
| RE28,720 | E | 2/1976 | Sedlak | 206/501 |
| 3,974,658 | A | 8/1976 | Starrett | 62/60 |
| 3,984,498 | A | 10/1976 | McChesney et al. | 260/879 |
| 4,005,586 | A | 2/1977 | Lyons | 62/372 |
| 4,019,340 | A | 4/1977 | Conklin | 62/371 |
| 4,027,776 | A | 6/1977 | Douglas | 220/281 |
| 4,065,336 | A | 12/1977 | Conklin | 156/69 |
| 4,106,660 | A | 8/1978 | Boyle | 220/90.4 |
| 4,124,141 | A | 11/1978 | Armentrout et al. | 220/306 |
| 4,141,463 | A | 2/1979 | Smith | 220/359 |
| 4,163,374 | A | 8/1979 | Moore et al. | 62/457 |
| 4,165,020 | A | 8/1979 | Hoselton | 220/306 |
| 4,168,334 | A | 9/1979 | Crandall et al. | 428/35 |
| 4,186,786 | A | 2/1980 | Kirkpatrick | 150/3 |
| 4,190,155 | A | 2/1980 | Higley | 206/445 |
| 4,211,267 | A | 7/1980 | Skovgaard | 150/2.1 |
| 4,223,800 | A | 9/1980 | Fishman | 220/352 |
| 4,238,934 | A | 12/1980 | Hotta | 62/457 |
| 4,262,815 | A | 4/1981 | Klein | 220/273 |
| 4,273,667 | A | 6/1981 | Kent et al. | 252/70 |
| 4,285,105 | A | 8/1981 | Kirkpatrick | 24/201 |
| 4,292,817 | A | 10/1981 | Loucks | 62/457 |
| 4,294,079 | A | 10/1981 | Benson | 62/60 |
| 4,304,106 | A | 12/1981 | Donnelly | 62/457 |
| 4,324,111 | A | 4/1982 | Edwards | 62/457 |
| RE30,962 | E | 6/1982 | Bridges | 220/23.6 |
| 4,338,795 | A | 7/1982 | House, Jr. | 62/372 |
| 4,341,324 | A | 7/1982 | Ramirez | 220/306 |
| 4,344,303 | A | 8/1982 | Kelly, Jr. | 62/530 |
| 4,347,943 | A | 9/1982 | Hackwell et al. | 220/306 |
| 4,349,119 | A | 9/1982 | Letica | 220/306 |
| 4,351,447 | A | 9/1982 | Graff | 220/306 |
| 4,357,809 | A | 11/1982 | Held et al. | 62/457 |
| 4,368,819 | A | 1/1983 | Durham | 206/545 |
| 4,383,422 | A | 5/1983 | Gordon et al. | 62/457 |
| 4,387,828 | A | 6/1983 | Yates, Jr. | 220/284 |
| 4,393,975 | A | 7/1983 | Moore | 206/385 |
| 4,409,383 | A | 10/1983 | Zalucha et al. | 528/499 |
| 4,418,833 | A | 12/1983 | Landis | 220/306 |
| 4,421,244 | A | 12/1983 | Van Melle | 220/306 |
| 4,421,560 | A | 12/1983 | Kito et al. | 106/21 |
| 4,426,014 | A | 1/1984 | Coltman, Jr. | 220/307 |
| 4,427,010 | A | 1/1984 | Marx | 128/402 |
| 4,444,332 | A | 4/1984 | Widen et al. | 220/306 |
| 4,444,846 | A | 4/1984 | Zalucha et al. | 428/425.6 |
| 4,470,264 | A | 9/1984 | Morris | 62/60 |
| 4,471,880 | A | 9/1984 | Taylor et al. | 220/306 |
| 4,485,636 | A | 12/1984 | Hilado | 62/430 |
| 4,488,817 | A | 12/1984 | Uesaka et al. | 366/149 |
| 4,498,312 | A | 2/1985 | Schlosser | 62/457 |
| 4,521,910 | A | 6/1985 | Keppel et al. | 383/10 |
| 4,528,694 | A | 7/1985 | Skovgaard | 383/10 |
| 4,530,440 | A | 7/1985 | Leong | 220/201 |
| 4,531,383 | A | 7/1985 | Zimmermann | 62/457 |
| 4,533,061 | A | 8/1985 | Herbst | 220/4 B |
| 4,533,578 | A | 8/1985 | Boyd et al. | 428/35 |
| 4,535,889 | A | 8/1985 | Terauds | 206/527 |
| 4,538,926 | A | 9/1985 | Chretien | 374/150 |
| 4,544,022 | A | 10/1985 | Tomac | 165/47 |
| 4,555,043 | A | 11/1985 | Bernhardt | 220/306 |
| 4,566,605 | A | 1/1986 | Rogers | 220/90.2 |
| 4,577,474 | A | 3/1986 | Peterson | 62/457 |
| 4,593,816 | A | 6/1986 | Langenbeck | 206/425 |
| D286,124 | S | 10/1986 | Dempsey | D7/2 |
| 4,632,272 | A | 12/1986 | Berenfield et al. | 220/324 |
| 4,666,949 | A | 5/1987 | Shimizu et al. | 521/114 |
| 4,669,275 | A | 6/1987 | Ohgushi et al. | 62/342 |
| 4,687,117 | A | 8/1987 | Terauds | 220/306 |
| 4,688,398 | A | 8/1987 | Baek | 62/342 |
| 4,691,664 | A | 9/1987 | Crowell | 119/61 |
| 4,717,710 | A | 1/1988 | Shimizu et al. | 503/213 |
| 4,721,210 | A | 1/1988 | Lawrence et al. | 206/459 |
| 4,747,510 | A | 5/1988 | Mack | 220/270 |
| 4,755,064 | A | 7/1988 | Weber | 383/110 |
| 4,765,506 | A | 8/1988 | Fishman et al. | 220/355 |
| 4,768,354 | A | 9/1988 | Barnwell | 62/457 |
| 4,768,668 | A | 9/1988 | Van Den Brink | 215/305 |
| D297,897 | S | 10/1988 | Stackhouse | D7/2 |
| 4,782,670 | A | 11/1988 | Long et al. | 62/457 |
| 4,789,073 | A | 12/1988 | Fine | 215/13.1 |
| 4,798,173 | A | 1/1989 | Wilgren | 119/61 |
| 4,809,868 | A | 3/1989 | Pomroy | 220/260 |
| 4,812,053 | A | 3/1989 | Bhattacharjee | 374/102 |
| 4,815,287 | A | 3/1989 | O'Daniel | 62/430 |
| 4,819,824 | A | 4/1989 | Longbottom et al. | 220/266 |
| 4,829,641 | A | 5/1989 | Williams | 24/587 |
| 4,841,743 | A | 6/1989 | Brier | 62/457.9 |
| 4,844,263 | A | 7/1989 | Hadtke | 206/508 |

4,846,095 A 7/1989 Emslander ..... 116/206
4,879,430 A 11/1989 Hoffman ..... 428/35.1
4,880,129 A 11/1989 McHenry et al. ..... 220/70
4,907,321 A 3/1990 Williams ..... 24/587
4,917,258 A 4/1990 Boyd et al. ..... 220/240
4,917,261 A 4/1990 Borst ..... 220/324
4,919,984 A 4/1990 Maruhashi et al. ..... 428/36.4
4,932,527 A 6/1990 Hayes ..... 206/428
4,934,558 A 6/1990 Vargas ..... 220/287
4,944,072 A 7/1990 Robson ..... 24/587
4,953,550 A 9/1990 Dunshee ..... 128/403
4,957,949 A 9/1990 Kamada et al. ..... 523/201
4,966,302 A 10/1990 Hjordie ..... 220/306
4,974,742 A 12/1990 Farrell et al. ..... 220/94
4,976,370 A 12/1990 Cassel ..... 220/306
4,981,234 A 1/1991 Slaughter ..... 220/415
4,986,438 A 1/1991 Borst ..... 220/315
4,989,419 A 2/1991 Brando et al. ..... 62/457.2
5,046,632 A 9/1991 Bordner ..... 220/276
5,048,307 A 9/1991 Baxter ..... 62/457.4
5,050,387 A 9/1991 Bruce ..... 62/60
5,052,369 A 10/1991 Johnson ..... 126/400
5,070,584 A 12/1991 Dais et al. ..... 24/587
5,079,932 A 1/1992 Siegel ..... 62/293
5,088,301 A 2/1992 Piepenbrink ..... 62/457.6
5,092,479 A 3/1992 Wells ..... 220/4.23
5,094,706 A 3/1992 Howe ..... 156/214
5,129,517 A 7/1992 Hustad ..... 206/467
5,138,750 A 8/1992 Gundlach et al. ..... 24/587
5,139,804 A 8/1992 Hoffman ..... 426/412
5,140,727 A 8/1992 Dais et al. ..... 24/587
5,147,059 A 9/1992 Olsen et al. ..... 220/281
5,154,086 A 10/1992 Porchia et al. ..... 73/818
5,165,573 A 11/1992 Kuboshima ..... 222/92
5,228,384 A 7/1993 Kolosowski ..... 99/342
5,231,850 A 8/1993 Morris ..... 62/457.6
5,235,819 A 8/1993 Bruce ..... 62/60
5,248,201 A 9/1993 Kettner et al. ..... 383/63
5,252,281 A 10/1993 Kettner et al. ..... 264/171
5,269,430 A 12/1993 Schlaupitz et al. ..... 220/4.23
5,271,244 A 12/1993 Staggs ..... 62/457.3
5,293,997 A 3/1994 Hustad et al. ..... 206/467
5,345,784 A 9/1994 Bazemore et al. ..... 62/371
5,348,181 A 9/1994 Smith et al. ..... 220/254
5,356,026 A 10/1994 Andress et al. ..... 220/306
5,356,222 A 10/1994 Kettner et al. ..... 383/63
5,361,604 A 11/1994 Pier et al. ..... 62/457.4
5,363,540 A 11/1994 Dais et al. ..... 24/587
5,372,274 A 12/1994 Freedland ..... 220/571
5,377,860 A 1/1995 Littlejohn et al. ..... 220/306
5,377,861 A 1/1995 Landis ..... 220/380
5,383,565 A 1/1995 Luch ..... 215/317
5,390,797 A 2/1995 Smalley et al. ..... 206/542
5,403,094 A 4/1995 Tomic ..... 383/63
5,425,467 A 6/1995 Feer et al. ..... 220/281
5,435,256 A 7/1995 Svehaug ..... 109/65
5,460,286 A 10/1995 Rush et al. ..... 220/306
5,480,482 A 1/1996 Novinson ..... 106/498
5,489,036 A 2/1996 Arkins ..... 215/343
5,490,956 A 2/1996 Kito et al. ..... 252/583
5,507,407 A 4/1996 Feer et al. ..... 220/281
5,518,133 A 5/1996 Hayes et al. ..... 220/306
5,542,234 A 8/1996 Wyslotsky et al. ..... 53/433
5,553,701 A 9/1996 Jarecki et al. ..... 206/15.2
5,555,746 A 9/1996 Thompson ..... 62/457.4
5,555,994 A 9/1996 Chen ..... 220/287
5,568,735 A 10/1996 Newkirk et al. ..... 62/457.7
5,575,398 A 11/1996 Robbins, III ..... 220/8
5,607,709 A 3/1997 Fritz et al. ..... 426/106
5,611,206 A 3/1997 Sargent ..... 62/3.6
5,624,051 A 4/1997 Ahern, Jr. et al. ..... 220/553
5,678,720 A 10/1997 Van Melle ..... 220/287
5,695,086 A 12/1997 Viola ..... 220/287
5,701,757 A 12/1997 Heverly ..... 62/457.2
5,718,124 A 2/1998 Senecal ..... 62/457.6
5,720,555 A 2/1998 Elele ..... 374/150
5,727,857 A 3/1998 Smith ..... 312/114
5,758,793 A 6/1998 Forsyth et al. ..... 220/270
5,772,070 A 6/1998 Hayes et al. ..... 220/781
5,806,710 A 9/1998 Shiffer et al. ..... 220/785
5,865,037 A * 2/1999 Bostic ..... 62/371
5,876,811 A 3/1999 Blackwell et al. ..... 428/34.1
5,887,437 A 3/1999 Maxim ..... 62/4
5,897,017 A 4/1999 Lantz ..... 220/592.1
D411,714 S 6/1999 Wilson et al. ..... D7/602
5,916,470 A 6/1999 Besser et al. ..... 219/730
5,921,432 A 7/1999 Van Berne et al. ..... 220/792
5,943,875 A * 8/1999 Hymes ..... 62/294
5,960,985 A 10/1999 Barrett ..... 220/780
5,972,292 A 10/1999 DeMeo ..... 422/25
5,992,679 A 11/1999 Porchia et al. ..... 220/782
D419,394 S 1/2000 Wilson et al. ..... D7/629
6,010,027 A 1/2000 Fujii et al. ..... 220/592.2
6,026,647 A 2/2000 Coffee et al. ..... 62/3.62
6,026,978 A 2/2000 Clegg et al. ..... 220/592.1
6,032,827 A 3/2000 Zettle et al. ..... 220/788
6,056,138 A 5/2000 Chen ..... 220/4.21
6,062,040 A * 5/2000 Bostic et al. ..... 62/530
6,067,810 A 5/2000 Jennings et al. ..... 62/246
6,068,898 A 5/2000 Oyama ..... 428/35.2
D428,310 S 7/2000 Zettle et al. ..... D7/629
6,082,410 A 7/2000 Pohar ..... 138/89
6,101,838 A 8/2000 Teague ..... 62/457.4
6,139,188 A 10/2000 Marzano ..... 383/110
6,151,911 A * 11/2000 Dando et al. ..... 62/457.3
6,168,044 B1 1/2001 Zettle et al. ..... 220/784
6,170,696 B1 1/2001 Tucker et al. ..... 220/793
6,196,404 B1 3/2001 Chen ..... 220/4.21
6,206,343 B1 * 3/2001 Kato et al. ..... 62/457.3
D440,470 S 4/2001 Tucker et al. ..... D7/629
D440,830 S 4/2001 Tucker et al. ..... D7/629
6,209,344 B1 * 4/2001 Mahajan ..... 62/457.3
6,213,302 B1 4/2001 Sanders et al. ..... 206/521.1
6,216,905 B1 4/2001 Mogard et al. ..... 220/257
6,217,136 B1 4/2001 Dorfman et al. ..... 312/135
D442,484 S 5/2001 Maxwell et al. ..... D9/347
6,228,804 B1 5/2001 Nakashima ..... 503/226
6,230,924 B1 5/2001 Weiss et al. ..... 220/713
D443,184 S 6/2001 Maxwell et al. ..... D7/629
D443,484 S 6/2001 Maxwell et al. ..... D7/629
D443,798 S 6/2001 Tucker et al. ..... D7/629
6,244,065 B1 6/2001 Wuestman ..... 62/457.6
D445,649 S 7/2001 Maxwell et al. ..... D7/629
D445,650 S 7/2001 Maxwell et al. ..... D7/629
6,257,434 B1 7/2001 Lizzio ..... 220/4.23
6,260,729 B1 7/2001 Mitchell et al. ..... 220/287
6,260,731 B1 7/2001 Cummings ..... 220/717
D446,077 S 8/2001 Tucker et al. ..... D7/392.1
6,273,258 B1 8/2001 Piacenza ..... 206/503
6,276,555 B1 8/2001 Edwards ..... 220/572
D447,382 S 9/2001 Tucker et al. ..... D7/392.1
6,283,298 B1 9/2001 Seidler ..... 206/581
6,286,705 B1 9/2001 Mihalov et al. ..... 220/359.3
D448,991 S 10/2001 Zettle et al. ..... D9/425
D449,495 S 10/2001 Tucker et al. ..... D7/629
6,305,546 B1 10/2001 Saunders et al. ..... 206/541
D450,983 S 11/2001 Tucker et al. ..... D7/629
6,315,151 B1 11/2001 Hupp et al. ..... 220/666
6,325,234 B1 12/2001 Legaspi ..... 220/367.1
6,343,709 B1 2/2002 DeForrest et al. ..... 220/327
6,349,820 B1 2/2002 Kelley et al. ..... 206/223
6,364,112 B1 4/2002 Pitschka ..... 206/460

| | | | | |
|---|---|---|---|---|
| 6,364,152 | B1 | 4/2002 | Poslinski et al. | 220/788 |
| 2001/0022304 | A1 | 9/2001 | Roche | |
| 2001/0023870 | A1 | 9/2001 | Mihalov et al. | |
| 2001/0047994 | A1 | 12/2001 | Von Holdt, Jr. | |

OTHER PUBLICATIONS

PCT Written Opinion dated Aug. 29, 2003; PCT/US 03/03958.

Tenneco Packaging (of Evanston, Illinois), Specialty Products Catalog, Summer of 1996.

Photographs of Central Fine Pack Container, Central Fine Pack, Inc. of Fort Wayne, Indiana (no date).

First concept page entitled "Introducing New Ziploc Cold-Loc Containers: Reusable containers that keep your food cold for hours."

Second concept page entitled "Introducing New Ziploc ColdLoc Containers: Reusable containers that keep your food cold for hours."

Third concept page entitled "Introducing New Ziploc Cold-Loc Containers: Reusable containers that keep your food cold for hours."

Fourth concept page entitled "Introducing New Ziploc Cold-Loc Containers: Reusable containers that keep your food cold for hours."

Fifth concept page entitled "Introducing New Ziploc Cold-Loc Containers: Reusable containers that keep your food cold for hours."

Pair of digital photographs (i.e., perspective and cross–sectional view) of a first sample container.

Pair of digital photographs (i.e., perspective and cross–sectional view) of a second sample container.

Pair of digital photographs (i.e., perspective and cross–sectional view) of a third sample container.

* cited by examiner

CONTAINER WITH PRESSURE RELIEF AND LID AND METHOD OF MANUFACTURE THEREFOR

CROSS REFERENCE TO RELATED APPLICATION

The present application comprises a continuation-in-part of U.S. application Ser. No. 10/073,559, filed Feb. 11, 2002, and owned by the assignee of the present application, and further claims priority from provisional U.S. application Ser. No. 60/392,728, filed Jun. 28, 2002.

TECHNICAL FIELD

The present invention relates generally to containers, and, more particularly, to a container having a pressure relief apparatus and lid, and a method of manufacture of such a container.

BACKGROUND ART

Cooling containers are used to contain a variety of products and maintain such products at a reduced temperature relative to ambient temperature for a prolonged period of time. An example of a cooling container is disclosed in E. L. Smith U.S. Pat. No. 2,526,165, which describes (in connection with FIG. 6 therein) a container having an outer bowl that surrounds an inner bowl wherein the bowls are hermetically sealed to define a chamber therebetween. A suitable refrigerant liquid such as water is disposed within the chamber. A user places the container into a household freezer for a long enough period of time to freeze the refrigerant liquid. Thereafter, the user takes the container out of the freezer and may place a product, such as a perishable food item, within the container. The refrigerant liquid is capable of maintaining the food item placed in the container at a temperature below room temperature for a relatively long period of time.

Some prior art containers using a coolant or refrigerant within a cavity have included air space within the cavity to allow for expansion of the refrigerant upon freezing. Allowing for such expansion prevents such containers from rupturing. Another strategy to prevent such rupture of a cooling container is disclosed in Hilado U.S. Pat. No. 4,485,636 where the bottom of the cavity is formed by a resilient diaphragm. The diaphragm allows for expansion of the refrigerant by compressing in response to the expanding refrigerant, thereby increasing the volume of the cavity and preventing the walls of the container from breaking as a result of the expanding refrigerant.

While numerous prior art containers deal with pressure increases within a cavity due to expansion of refrigerant upon freezing, no known attempts have been made for handling pressure increases resulting from increased heat. It is possible that if a user were to place a prior art container having a substance in a sealed cavity within a microwave oven or near a radiant heat source, sufficient heat and pressure would develop within the sealed cavity to rupture the walls of the container.

In addition to the foregoing, it is desirable to have a lid that seals a container adequately over a broad temperature range. This can be difficult for containers and lids that expand or contract in response to temperature change. Some prior art containers and lids used therewith have dealt with expansion and contraction by constructing both the container and lid of a resilient material that accommodates such expansion or contraction. An example of such a container and lid is disclosed in Tupper U.S. Pat. No. 2,752,972. At least one type of container utilizes a lid wherein the lid and container have different coefficients of thermal expansion ("CTE"). For example, Fishman U.S. Pat. No. 4,223,800 discloses a lid and a receptacle. The lid includes a top portion made of the same material as the receptacle and a bottom portion wherein the bottom portion is made of a resilient material with a greater CTE than the receptacle. The bottom portion is integral with a resilient bead. The resiliency of the bead causes the bead to deform into sealing engagement with a wall of the receptacle when the lid is placed on the receptacle. When the receptacle and lid are placed in a refrigerator the bottom portion shrinks to a greater degree than the receptacle. However, sealing engagement of the bead and the wall of the receptacle is maintained by the matching CTE's of the top portion and the receptacle.

While numerous prior art containers incorporate lids that seal despite expansion of the container and/or lid, no known attempts have been made in the art to provide a lid that seals adequately despite expansion of a cooling container.

SUMMARY OF THE INVENTION

In accordance with one aspect of the present invention, a container comprises a sealed cavity defined by first and second walls of the container. A coolant is disposed within the cavity wherein the coolant is capable of assuming first and second phases. A portion of the first wall is joined to the second wall wherein the portion includes an off-center opening. The portion is rupturable to limit pressure in the sealed cavity. The container further comprises a container rim and a lid having an outer channel and a tab. The outer channel receives the container rim and defines a first width. The tab has a second width substantially equal to the first width. There is a first interference fit of the channel with the container rim when the coolant is in the first phase. There is a second interference fit, different than the first interference fit, when the coolant is in the second phase.

According to a further aspect of the invention, a method of manufacturing a container includes the steps of providing first and second container portions and placing a coolant in the second container portion. The first container portion is placed within the second container portion, a region of the second container portion is joined to the first container portion, and an opening is formed in the region.

A further alternative aspect of the present invention comprehends a method of manufacturing a container including the steps of providing a coolant within the container wherein the coolant is capable of assuming first and second phases and providing a lid that forms first and second seals with the container. A nominal interference for the first seal is selected and is effective when the container is exposed to a particular condition. The second seal ensures sealing of the lid with the container when the container is exposed to a condition other than the particular condition.

According to another aspect of the present invention, a container comprises a container body including a hollow cavity and a rim. A coolant is disposed within the hollow cavity wherein the coolant is capable of assuming first and second phases. A lid has a peripheral member wherein the peripheral member forms first and second seals with the rim and wherein the seals have different interference fits with the rim when the container is exposed to different temperatures.

According to a further aspect of the invention a lid for a container includes a peripheral member defining an outer channel. The peripheral member has a peripheral wall that carries a bead. The bead contacts a rim of the container. A tab extends from the peripheral wall and interrupts contact of the bead with the rim. The outer channel has a first width, and the tab has a second width substantially equal to the first width.

In accordance with a still further aspect of the invention, a lid for a container, includes an outer channel of a first width and a tab extending outwardly from the channel. The tab has a second width substantially equal to the first width.

In accordance with yet another aspect of the invention, a lid for a container comprises an outer channel defined by a peripheral wall that carries a bead. The bead contacts a rim of the container. A tab extends outwardly from the peripheral wall and interrupts contact of the bead with the rim.

Other aspects and advantages of the present invention will become apparent upon consideration of the following detailed description.

DESCRIPTION OF THE PREFERRED EMBODIMENTS

Figure 1:
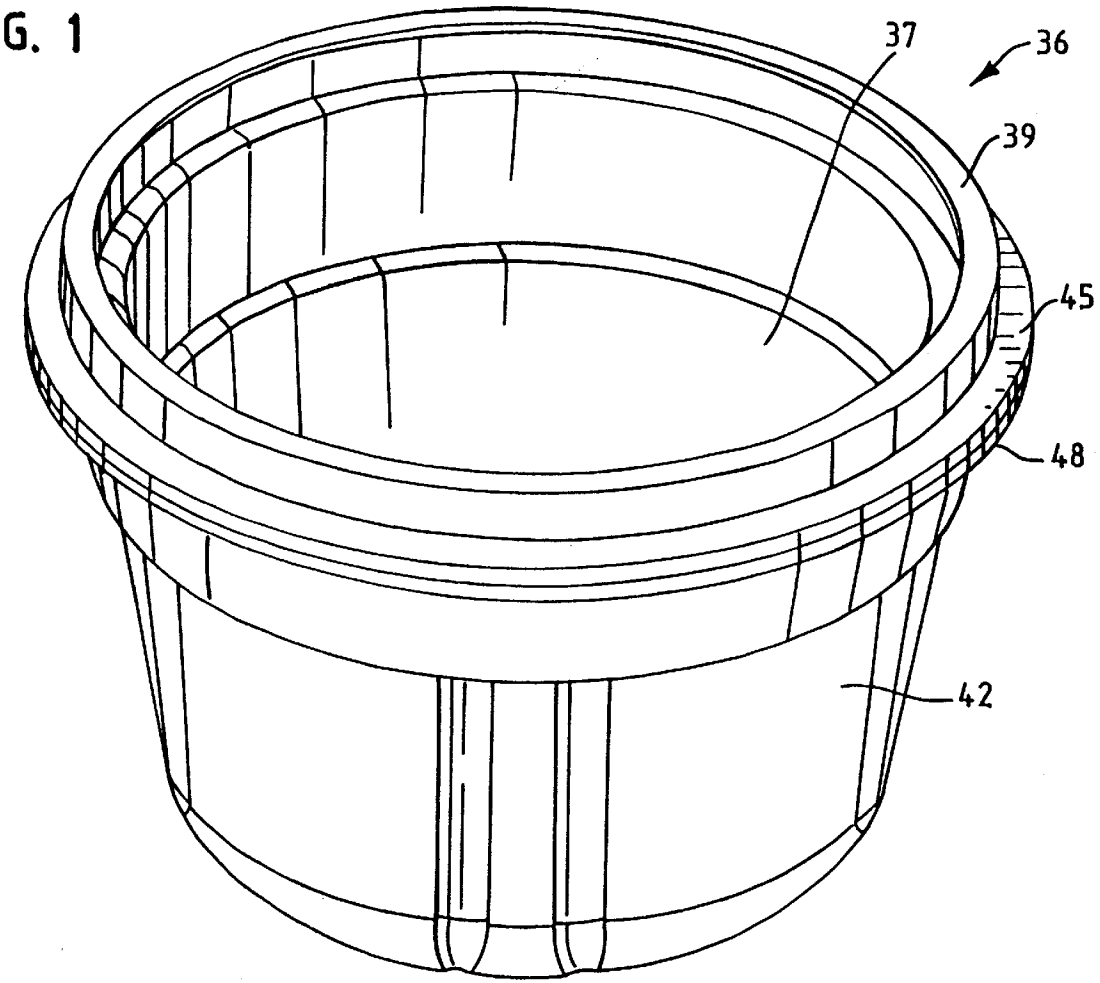
FIG. 1 is an isometric view of a container according to the present invention looking down from above.
Figure 2:
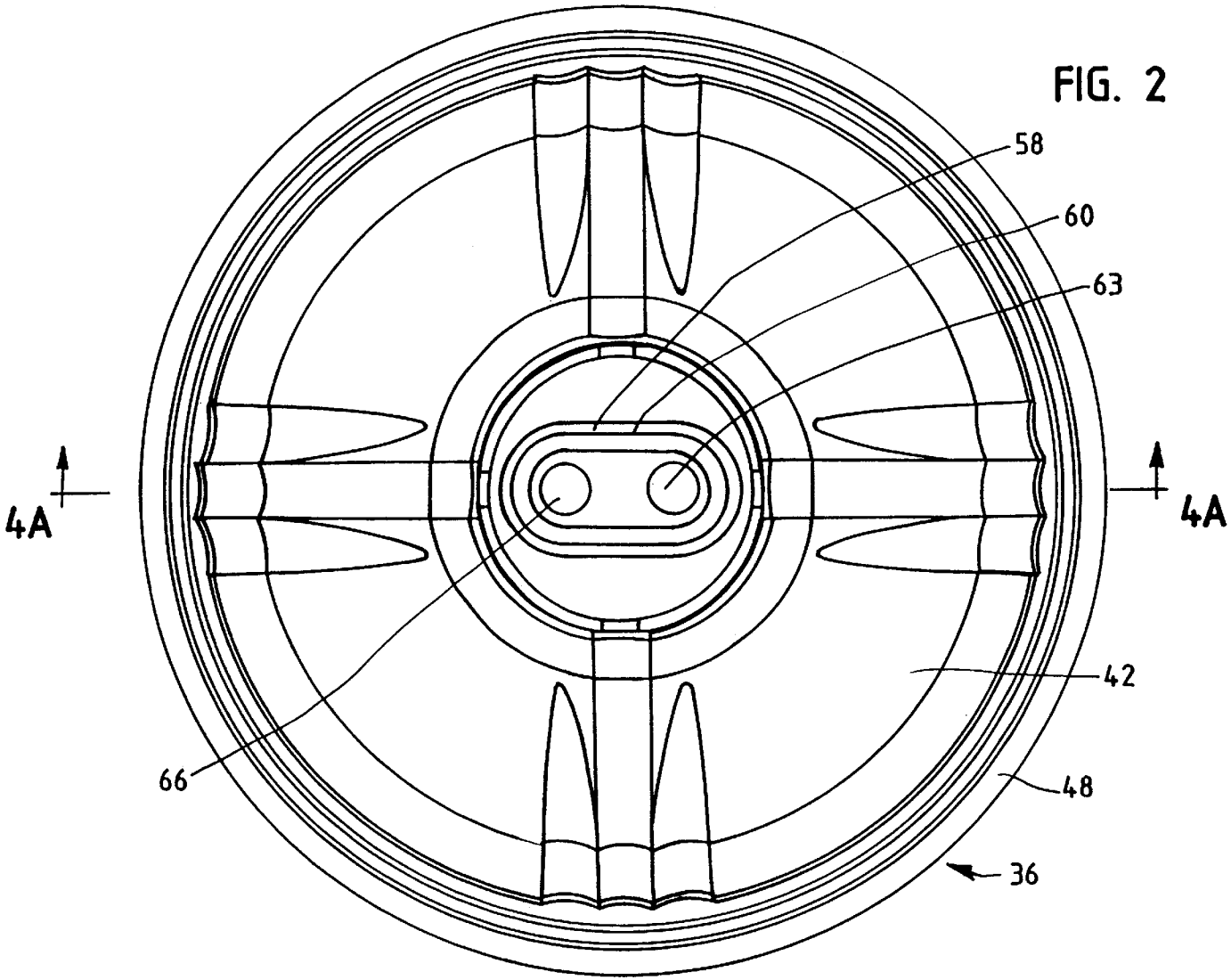
FIG. 2 is a bottom view of the container of FIG. 1.
Figure 4A:
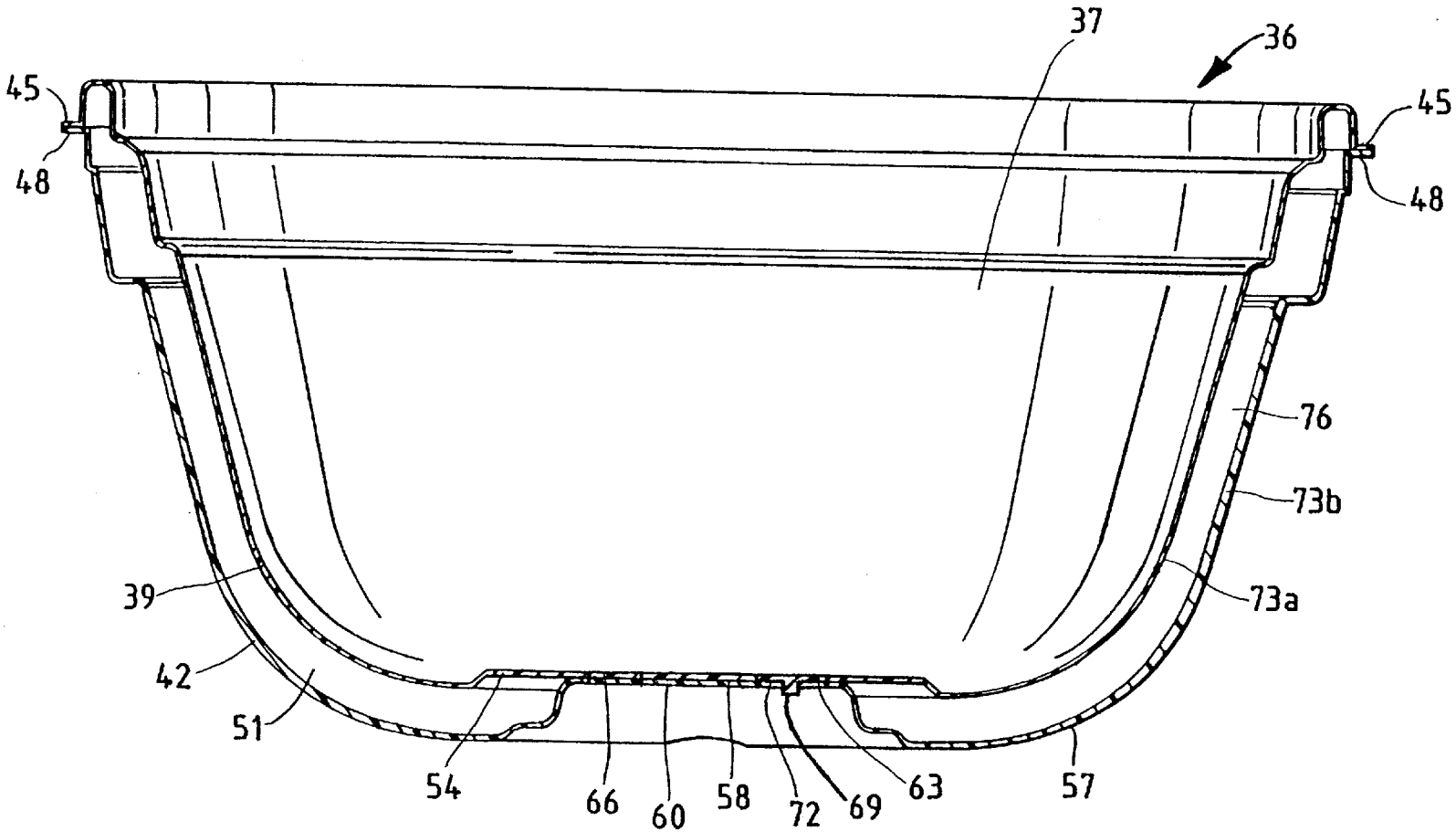
FIG. 4A is a sectional view taken generally along the lines 4A—4A of FIG. 2.

Referring now to FIG. 1, a container 36 defines an interior space 37 for placement of products therein. Referring also to FIG. 4A, the container 36 includes a first container portion 39 and a second container portion 42. The container portions 39 and 42 are constructed of polypropylene but other suitable materials may be employed. The first container portion 39 includes a first rim 45. The second container portion 42 includes a second rim 48 wherein the second rim 48 is joined to the first rim 45, thereby defining a sealed cavity 51 between the container portions 39 and 42. The rims 45 and 48 may be joined by any suitable means including ultrasonic welding, spin welding, hot plate welding or by use of an adhesive, but the portions 39 and 42 are preferably joined by vibration welding. Alternatively, the portions 39 and 42 could be joined in a mechanical fashion (not shown), such as by press fitting or interfitting, such that the portions 39 and 42 are substantially sealed to define the cavity 51. A coolant (not shown) is placed within the sealed cavity 51. The first container portion 39 includes a first base portion 54, and the second container portion 42 includes a second base portion 57. A pressure relief apparatus 58 comprises a joined section 60 (seen also in FIG. 2) that joins the first base portion 54 to the second base portion 57 at first and second connection regions 63 and 66.

Any suitable coolant may be disposed within the cavity 51, but preferably the coolant is a cross-linked gel having a generally solid structure such that if the gel were heated the gel matrix tends to remain intact allowing only water vapor to escape from the gel matrix. In operation, the container 36 is first placed in a freezer for a long enough time to freeze the gel. Thereafter, a user may take the container 36 out of the freezer and place products within the interior space 37. The frozen gel should maintain food or other perishable items placed within the interior space 37 of the container 36 within a temperature range between about 10° C. to about 15.5° C. for about four to about six hours in a room temperature environment. In an above room temperature environment, the time and temperature ranges are affected somewhat depending on the ambient temperature. A preferred formulation of the gel comprises a mixture of about 98.2% water and a solid polymer blend of about 1.8% to about 2.1% solids. The solids include about 80–85% sodium carboxymethylcellulose, roughly 10–16% sodium benzoate and about 4–6% cross-linkers. The solid polymer blend is available from Progressive Polymer Application of Sheridan, Wyo. and is sold under the trade name UNIGEL. A small amount of paraben (an anti-microbial preservative) is added to the gel as an additional component of the preferred gel formulation. Of course, other suitable gel formulations may be employed. It should be noted that the container 36 is not limited to use with only perishable food products. Rather, many other products may be kept cool by placement within the container 36. For example, human organs intended for transplant surgery may be placed temporarily therein. Alternatively, a cosmetic product, beverage or chemical compound may be placed in the container 36.

Figure 3:
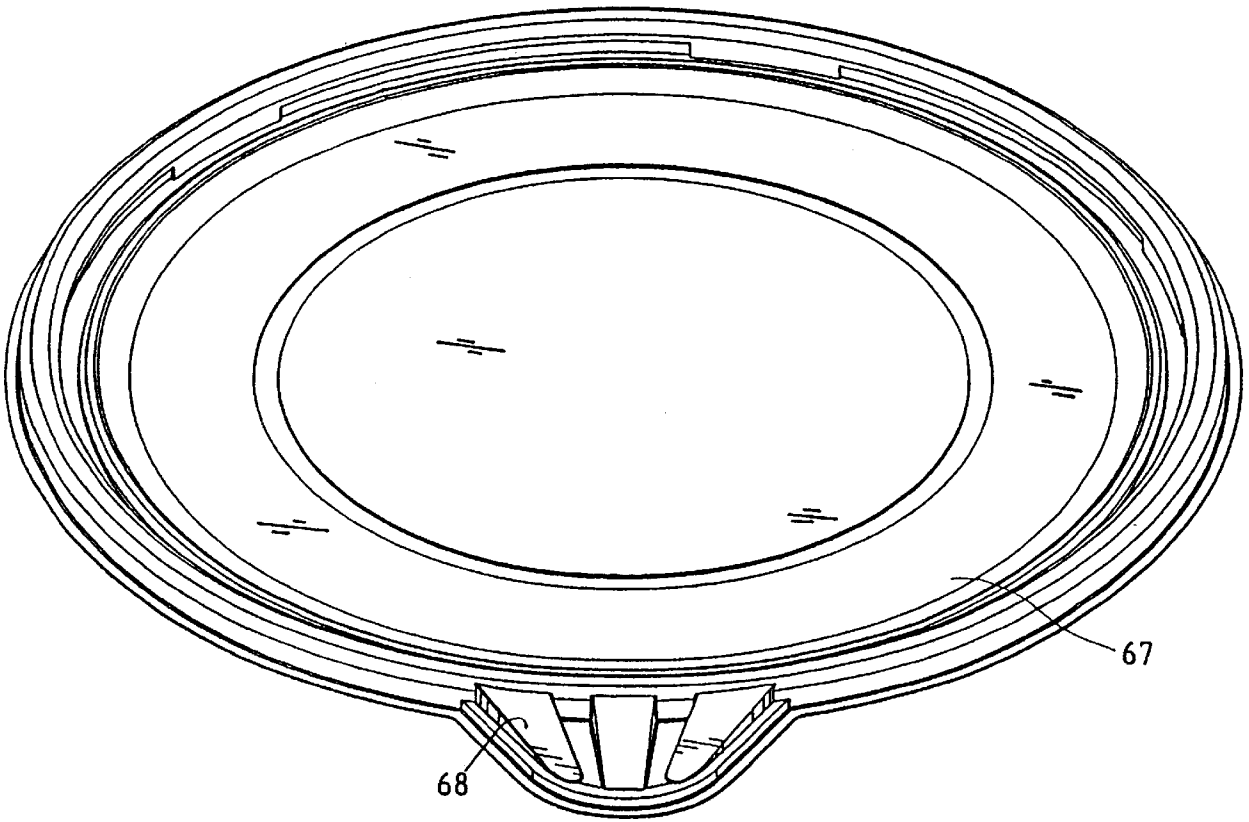
FIG. 3 is an isometric view of a lid for use with the container of FIG. 1 looking down from above.

FIG. 3 illustrates a lid 67 that may be used to seal contents placed within the container 36 in an airtight manner. The lid 67 includes a grasping tab 68 to facilitate removal of the lid 67.

Assembly of the container 36 includes the following steps. The components of the gel are mixed together at room temperature. While still in a liquid state, the gel is poured into the second container portion 42. The first container portion 39 is placed within the second container portion 42, thereby displacing the gel upwardly along the walls of the portions 39 and 42 defining the cavity 51. Within several hours, the gel cures such that it assumes a generally solid structure. Thereafter or before curing of the gel, the joined section 60 is vibration welded to join the base portions 54 and 57. Simultaneously, the rims 45 and 48 are also joined together by vibration welding to seal the cavity 51. However, the respective steps of welding the portions 54 and 57 and of welding the rims 45 and 48 could be performed sequentially.

Figure 4B:
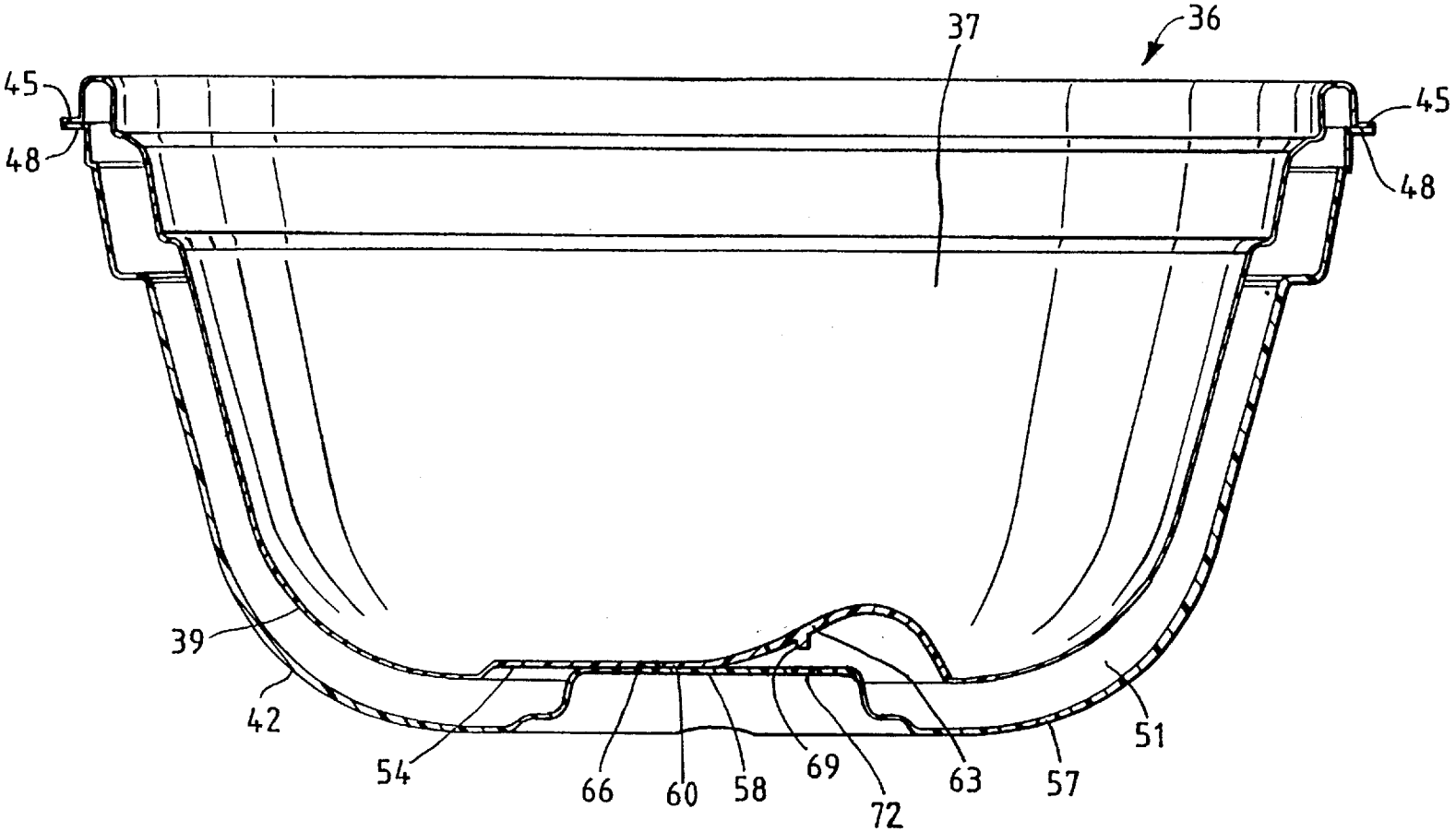
FIG. 4B is a sectional view similar to FIG. 4A illustrating rupture of a first connection region.

Referring to FIGS. 4A and 4B, the first connection region 63 includes a projection portion 69 integral with the first container portion 39. The projection portion 69 is vibration welded within an opening 72 of the second container portion 42. The opening 72 is preferably about ⅛ inch in diameter. The first connection region 63 is rupturable upon exposure to elevated pressure within the sealed cavity 51. The elevated pressure may result from heating the gel and/or container 36 such as by placement in a microwave oven. Heat developed within the sealed cavity 51 elevates pressure within the sealed cavity 51 forcing the walls of the first and second container portions 39 and 42 to push away from one another. When sufficient elevated pressure is reached, the walls of the first and second container portions 39 and 42 push away from one another with sufficient force to cause separation (rupture) of the first connection region 63. During separation, the base portion 54 carries the projection portion 69 upwardly away from the base portion 57, thereby removing the projection portion 69 out of the opening 72 and exposing the cavity 51 to the opening 72 as illustrated in FIG. 4B. Exposure of the opening 72 allows steam from the heated gel (or other heated coolant in vapor and/or solid form) to escape from the cavity 51. This prevents the walls of the container 36 from rupturing.

Figure 5:
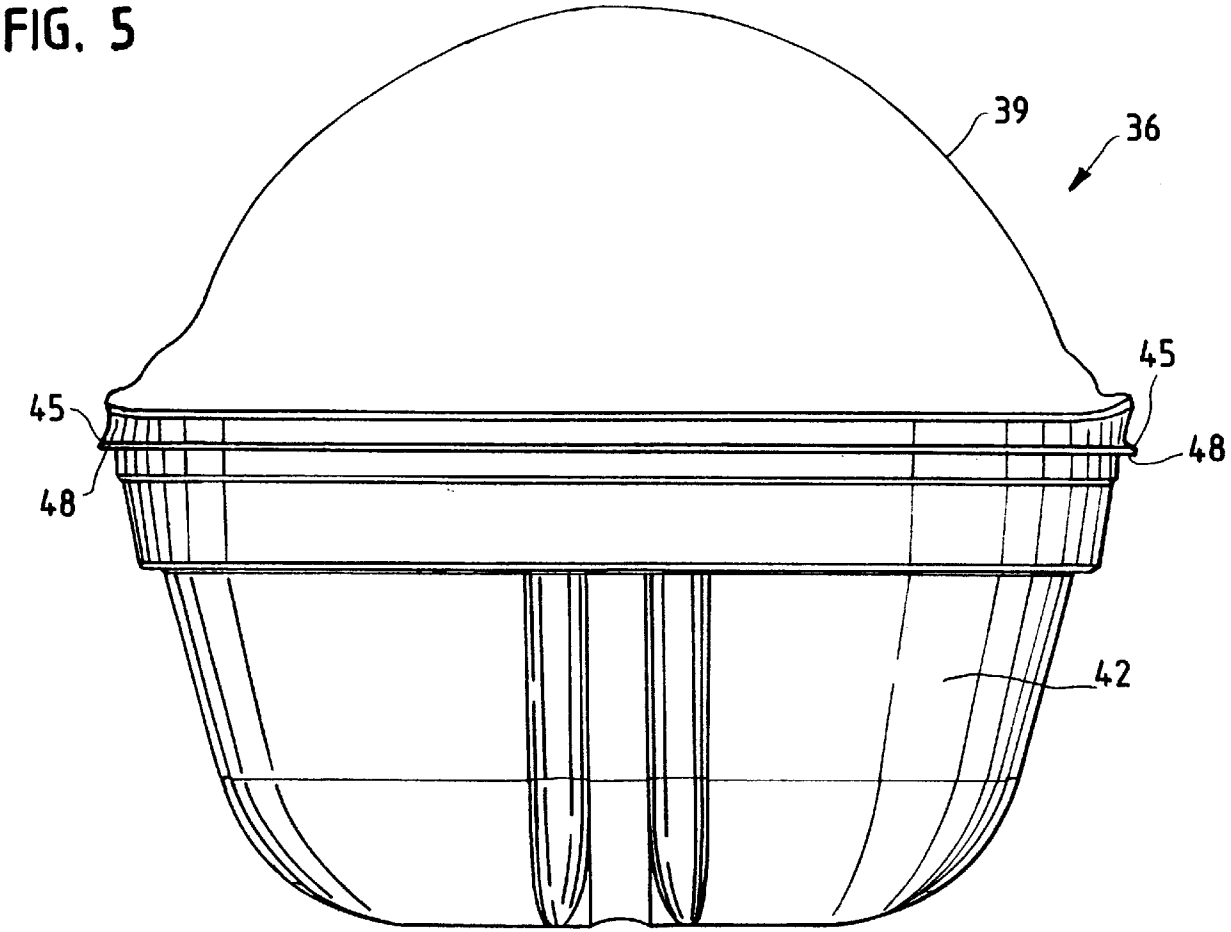
FIG. 5 is a front elevational view of a container which does not include a second connection region.

It should be noted that the joined section 60 could alternatively join side portions 73*a* and 73*b* (FIG. 4A) of the respective first and second container portions 39 and 42 together. However, the joined section 60 preferably joins the base portions 54 and 57. The opening 72 could also be disposed in the first container portion 39. However, the opening is preferably disposed in the second container portion 42 to prevent contamination of product placed within the interior space 37 of the container 36 by the heated gel. The second connection region 66 joins the first and second container portions 39 and 42 together more securely than the first connection region 63 such that when an elevated pressure is reached within the cavity 51, the first connection region 63 ruptures exposing the opening 72 while the second connection region 66 remains intact. The connection region 66 thus prevents possible inversion of the container portion 39, for example as illustrated in FIG. 5. In this regard, once the first connection region 63 ruptures, the cavity 51 is no longer sealed and it is not possible for sufficient pressure to develop within the unsealed cavity to cause rupture of the second connection region 66.

As described above, the first connection region 63 ruptures in response to elevated pressure to limit pressure in the sealed cavity 51. However, the region 63 could be replaced with a region that alternatively limits elevated pressure by rupturing in response to a different parameter, such as an elevated temperature. By way of example only, a region could be employed that melts below the boiling point of the coolant within the cavity 51. Melting of the region exposes the cavity 51 to the ambient surroundings so that pressure in the cavity 51 is limited. For example, the projection portion 69 might be constructed of a material having such a relatively low melting point that the portion 69 melts in response to such temperature, thereby exposing the opening 72 to the cavity 51. Alternatively, the portion 69 might consist of a material that splinters or cracks in response to such temperature, thereby exposing the opening 72. In such a container, the second connection region 66 would not melt or otherwise rupture in response to the elevated temperature, and as in other embodiments described herein, would prevent possible inversion illustrated in FIG. 5.

Figure 6A:
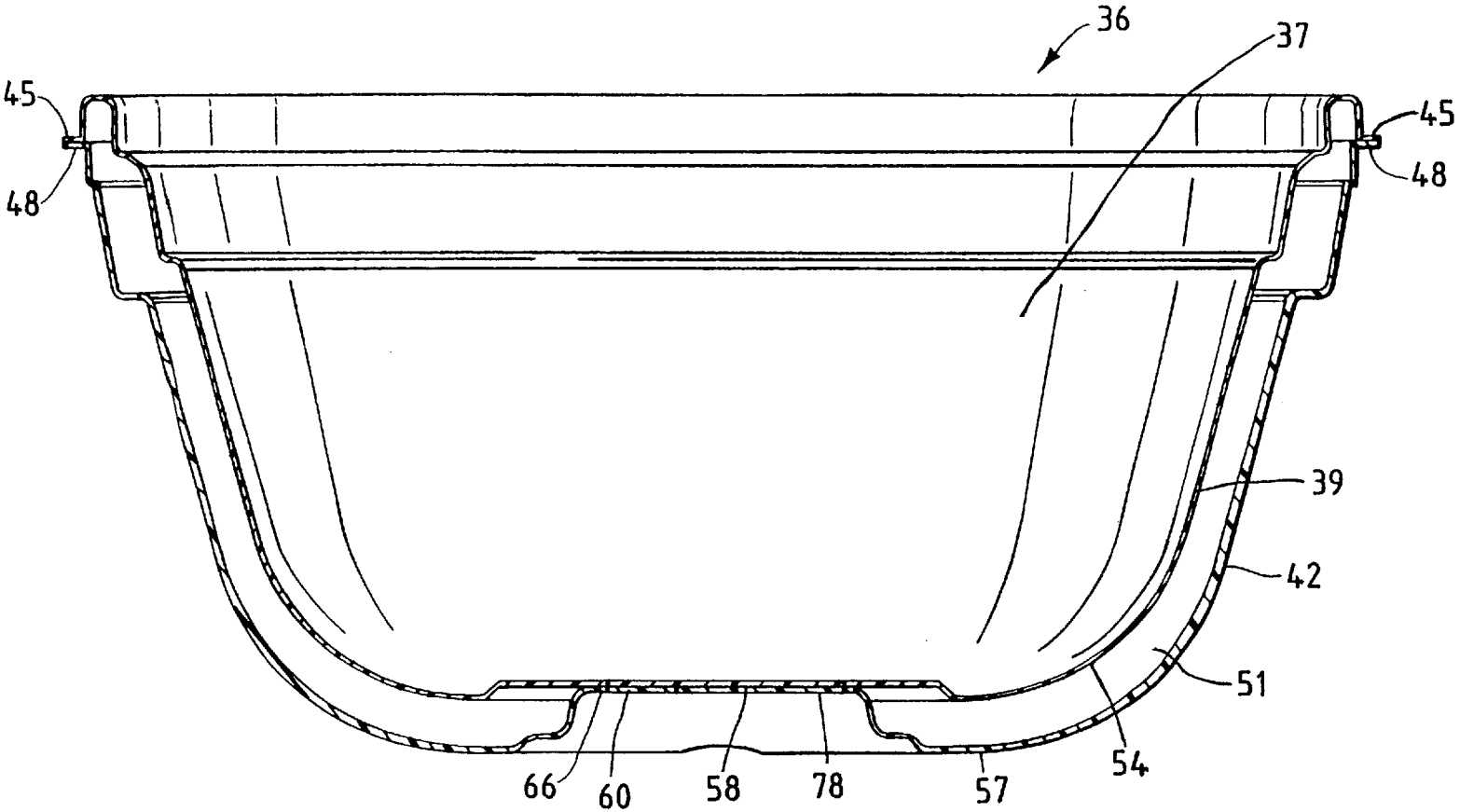
FIG. 6A is a sectional view similar to FIG. 4A of a second embodiment of a container illustrating a tear-away weld as the pressure relief apparatus.
Figure 6B:
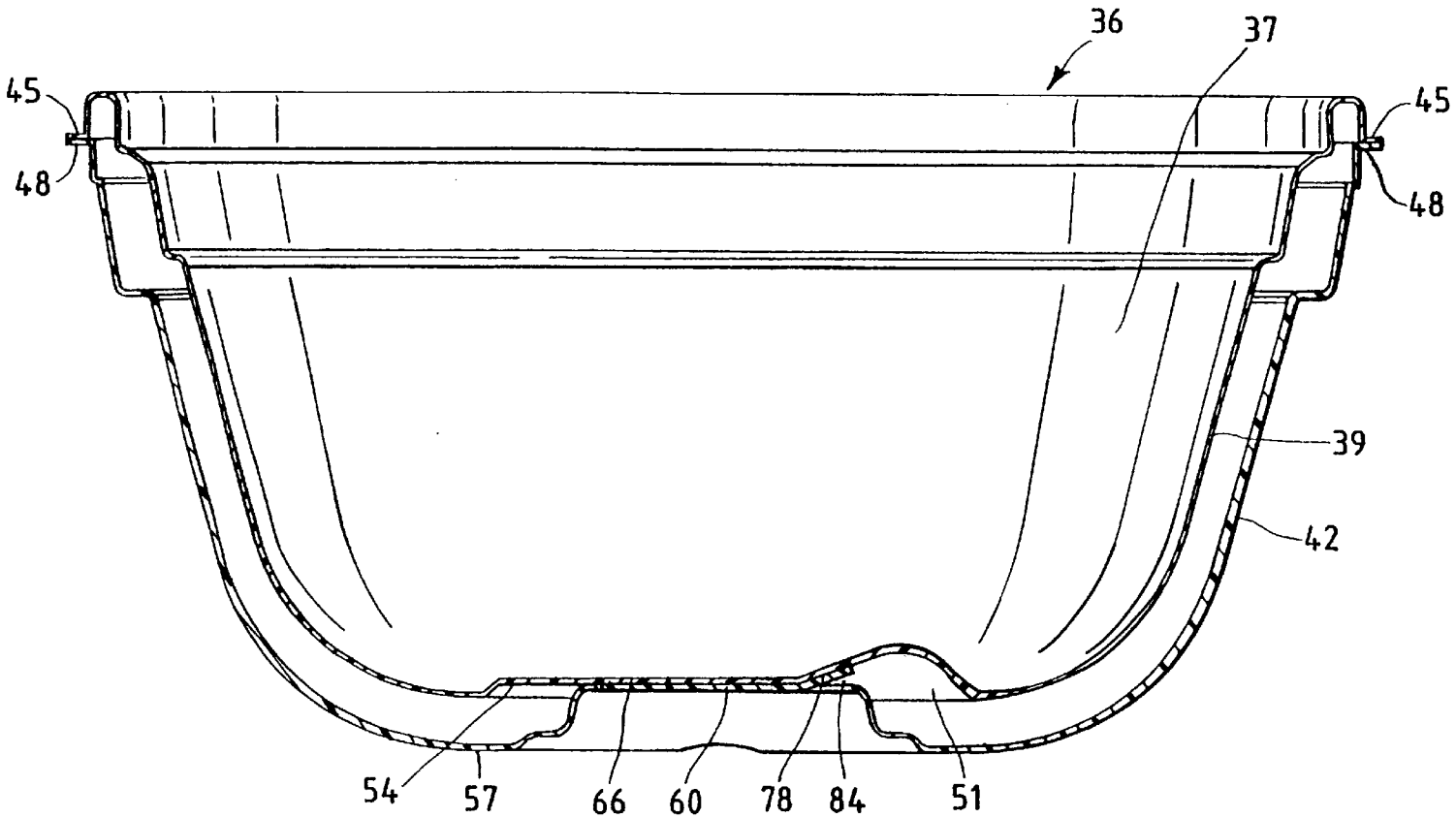
FIG. 6B is a sectional view similar to FIG. 4A illustrating rupture of the tear-away weld of the container of FIG. 6A.

FIGS. 6A and 6B illustrate a second embodiment wherein elements common to the various embodiments are given like reference numerals. The first connection region 63 is replaced by a tear-away weld 78 connecting the base portions 54 and 57 adjacent the connection region 66. Upon exposure to an elevated pressure, the base portion 54 separates from the base portion 57 such that the portion 54 tears away a part of the portion 57 welded thereto (at the weld 78) to create an opening 84 (seen in FIG. 6B). The newly created opening 84 exposes the cavity 51, thereby preventing undesirable pressure build-up therein. As discussed above, the assembly of the container 36 includes the step of first filling the container portion 42 with gel while the gel is still in a pourable, liquid state. In the first embodiment illustrated in FIGS. 4A and 4B, pouring the liquid gel into the container portion 42 might result in some spilling or leakage of the gel through the opening 72 in the second container portion 42. The embodiment illustrated in FIGS. 6A and 6B overcomes this problem by employing the tear-away weld 78 that does not require a pre-existing opening (like the opening 72) in the container portion 42. It should be noted that the weld 78 could alternatively create several smaller openings or perforations (not shown) in the base portion 57 rather than the single opening 84.

Figure 7:
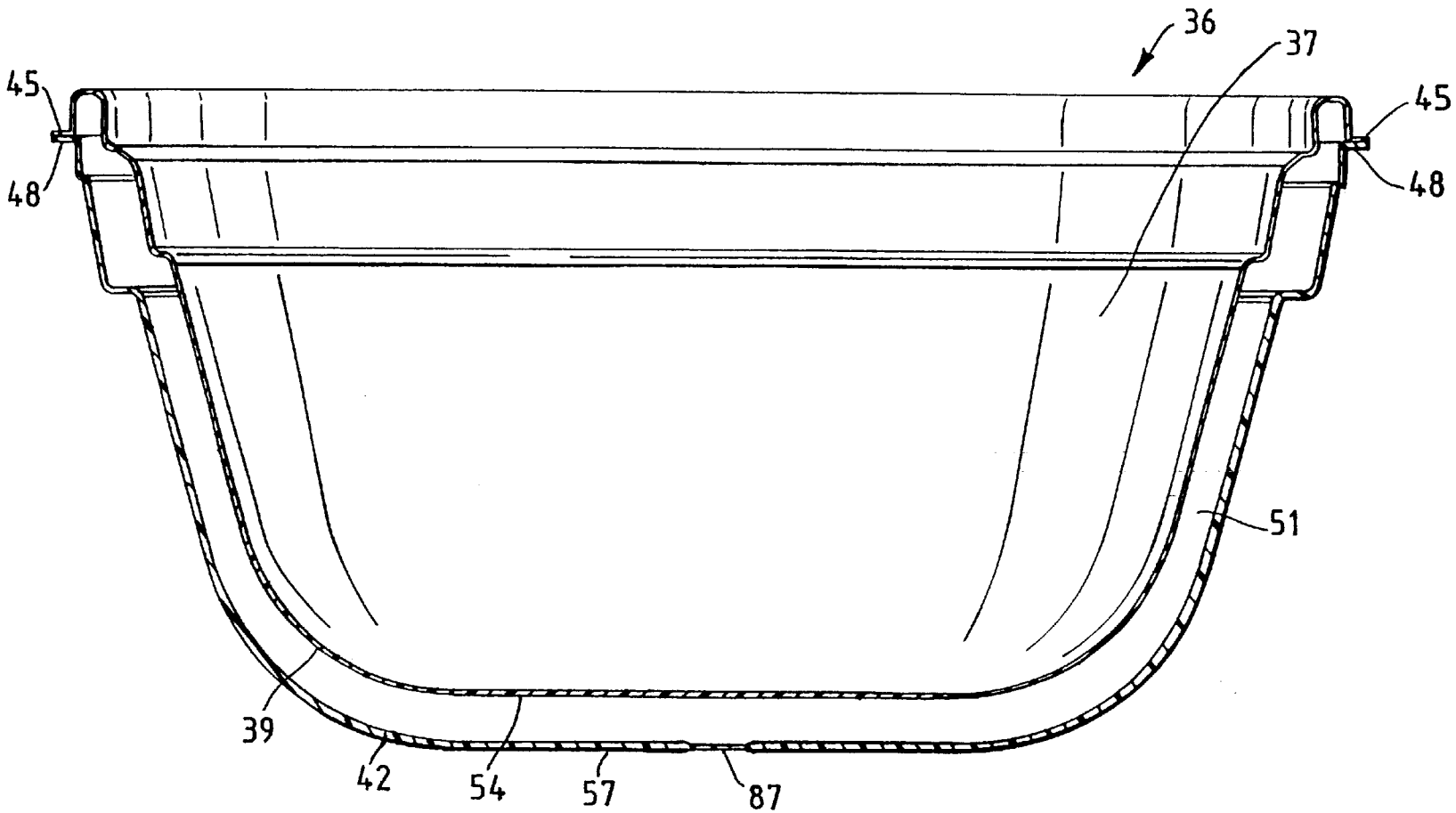
FIG. 7 is an enlarged sectional view similar to FIG. 4A of a third embodiment of a container illustrating a thinned wall portion as the pressure relief apparatus.

FIG. 7 illustrates a third embodiment wherein the joined section 60 is replaced by a thinned wall portion 87 preferably disposed in the base portion 57 of the second container portion 42. Exposure to an elevated pressure in the cavity 51 causes the portion 87 to rupture. A connection region (not shown) identical to the connection region 66 could be disposed near the portion 87 in this or any of the following embodiments discussed hereinafter.

Figure 8:
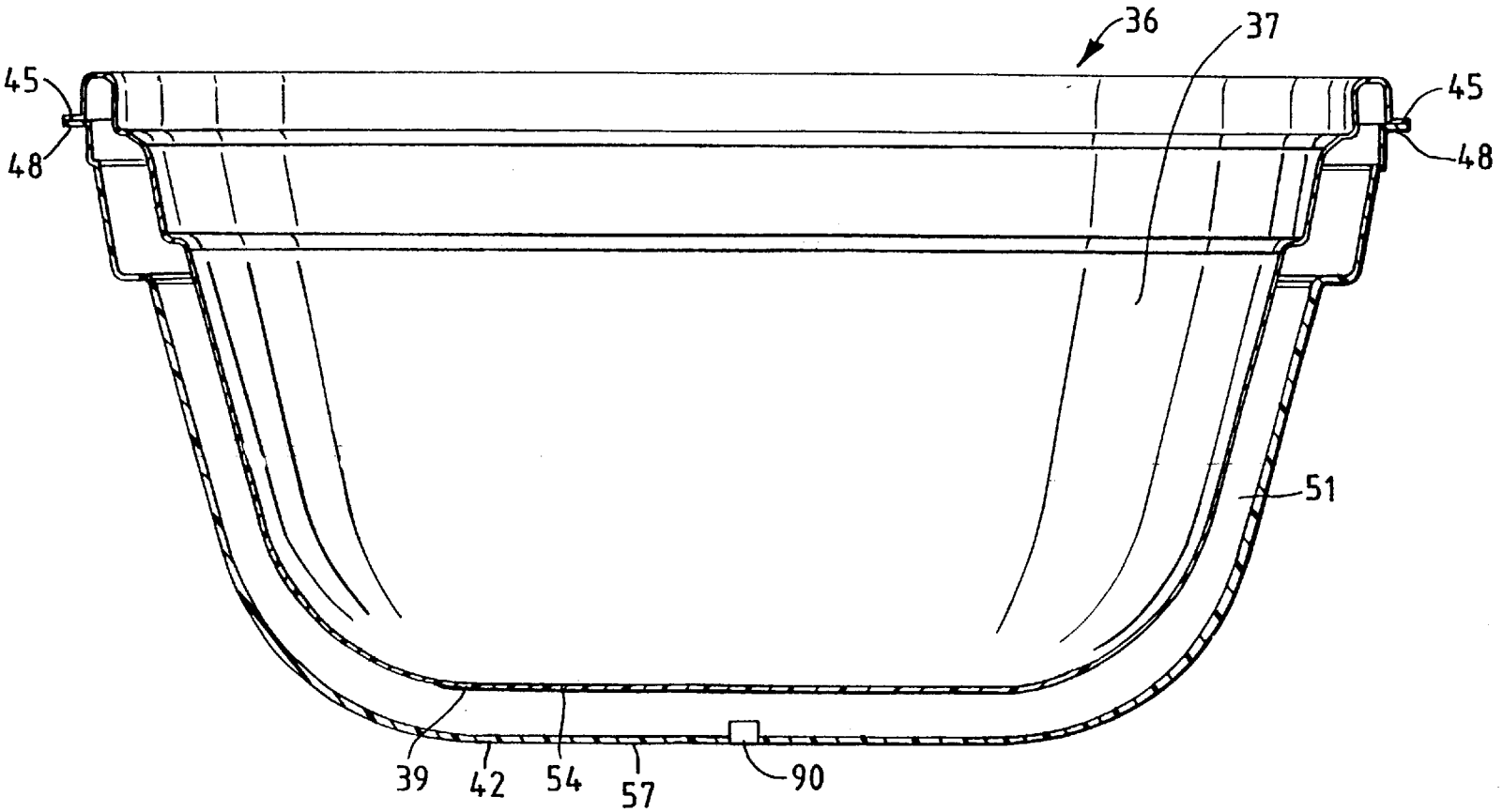
FIG. 8 is a sectional view similar to FIG. 4A of a fourth embodiment of a container illustrating a valve as the pressure relief apparatus.

FIG. 8 illustrates a fourth embodiment wherein the joined section 60 is replaced by a valve 90 that opens in response to an elevated pressure in the cavity 51 to limit pressure in the cavity 51.

Figure 9:
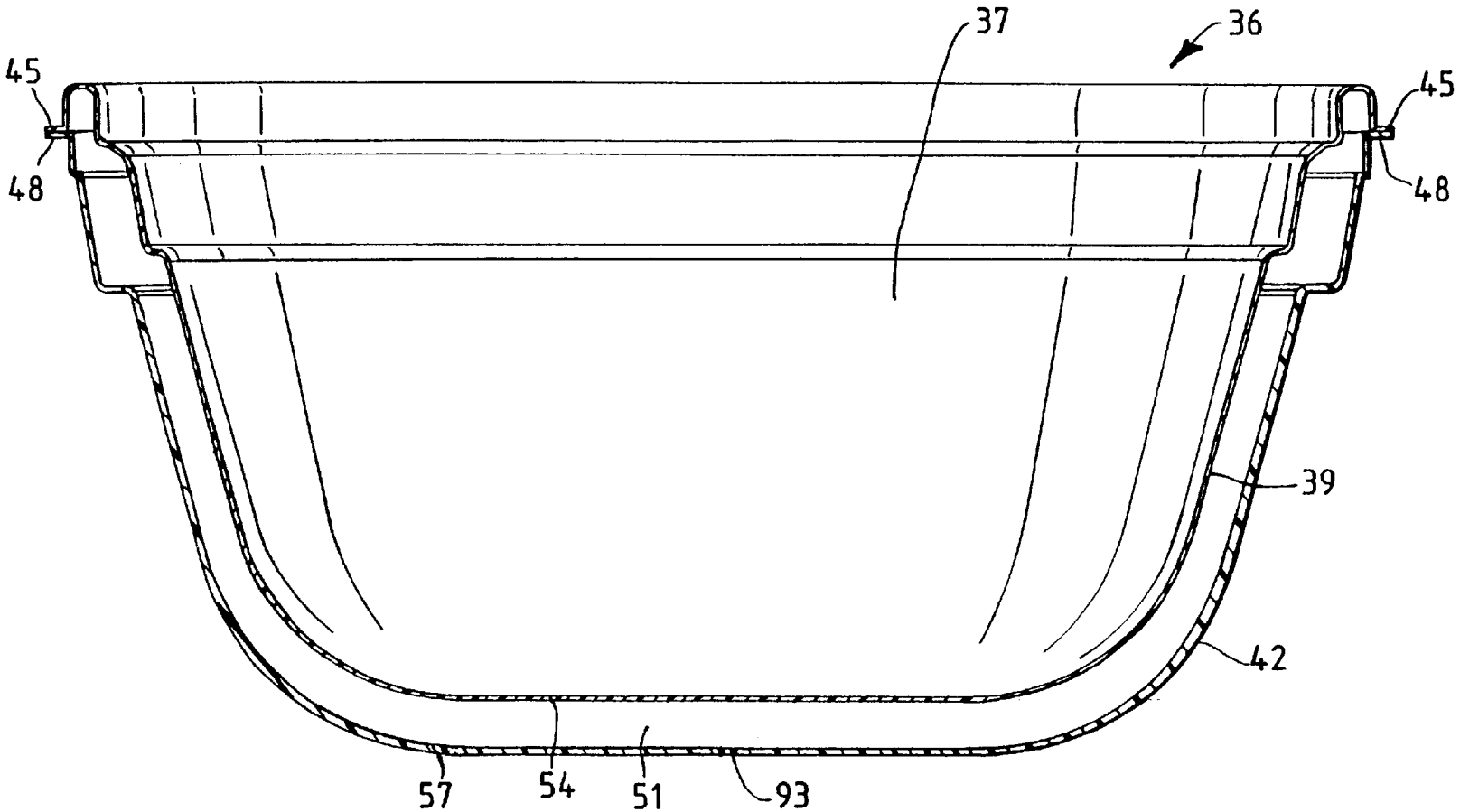
FIG. 9 is an enlarged full sectional view of a fifth embodiment illustrating an opening as the pressure relief apparatus.

FIG. 9 illustrates a fifth embodiment wherein the joined section 60 is replaced by a small opening 93 disposed in one of the container portions 39 or 42 (but preferably in the base portion 57 of the container portion 42) which prevents pressure rise beyond a certain level. A resilient plug (not shown) made of rubber or other suitable material could be disposed within the opening 93 to prevent contaminants from entering the cavity 51. Such a plug would eject from the opening in response to an elevated pressure in the cavity 51.

Figure 10:
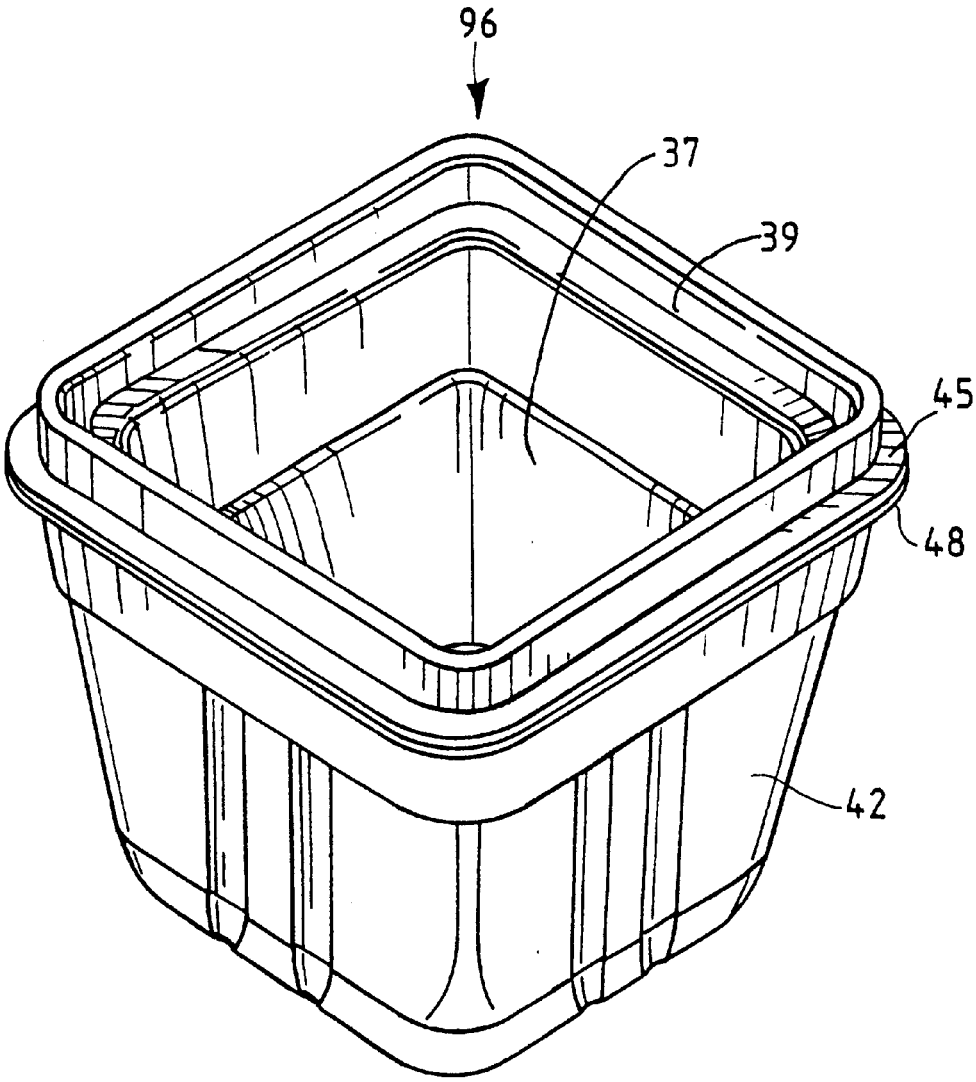
FIG. 10 is an isometric view of a sixth embodiment of a container illustrating a different shape of container looking down from above.
Figure 11:
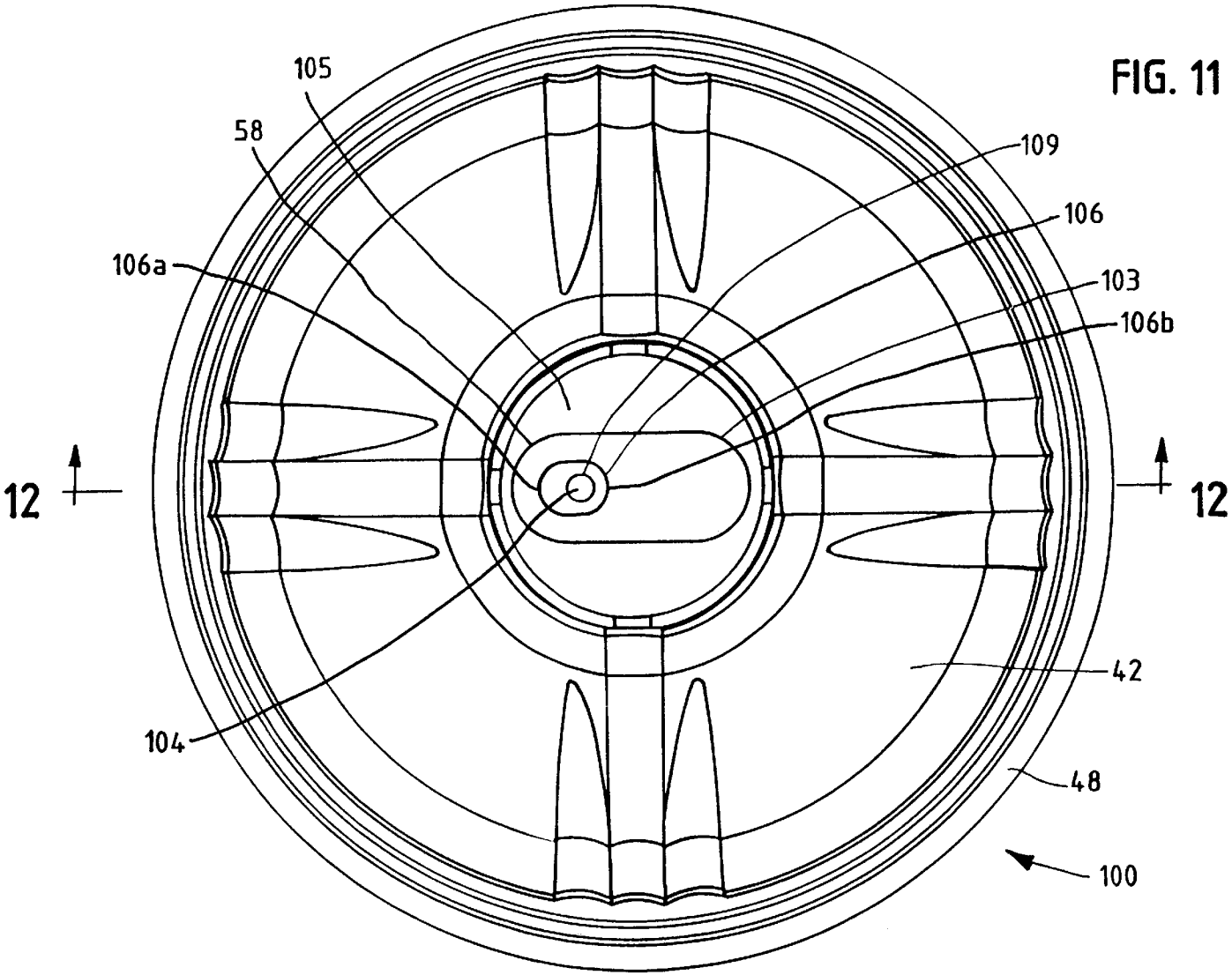
FIG. 11 is a bottom view of a seventh embodiment of a container.

FIG. 10 illustrates a sixth embodiment of a square container 96 that incorporates pressure relief apparatus, but which differs from the container 36 in shape. A lid (not shown) of suitable dimension could be placed on the container to seal products placed within the interior space 37. It should be evident from the container 96 of FIG. 10 that many variations of geometric shape and dimension are possible for a container incorporating any of the pressure relief apparatuses illustrated in FIGS. 4A and 4B and FIGS. 6–9.

FIGS. 11 through 20 illustrate another embodiment of a container 100 according to the present invention wherein many of the features of the embodiment are similar in structure and function to the embodiments described above. As before, elements common to the various embodiments are given like reference numerals.

Figure 12:
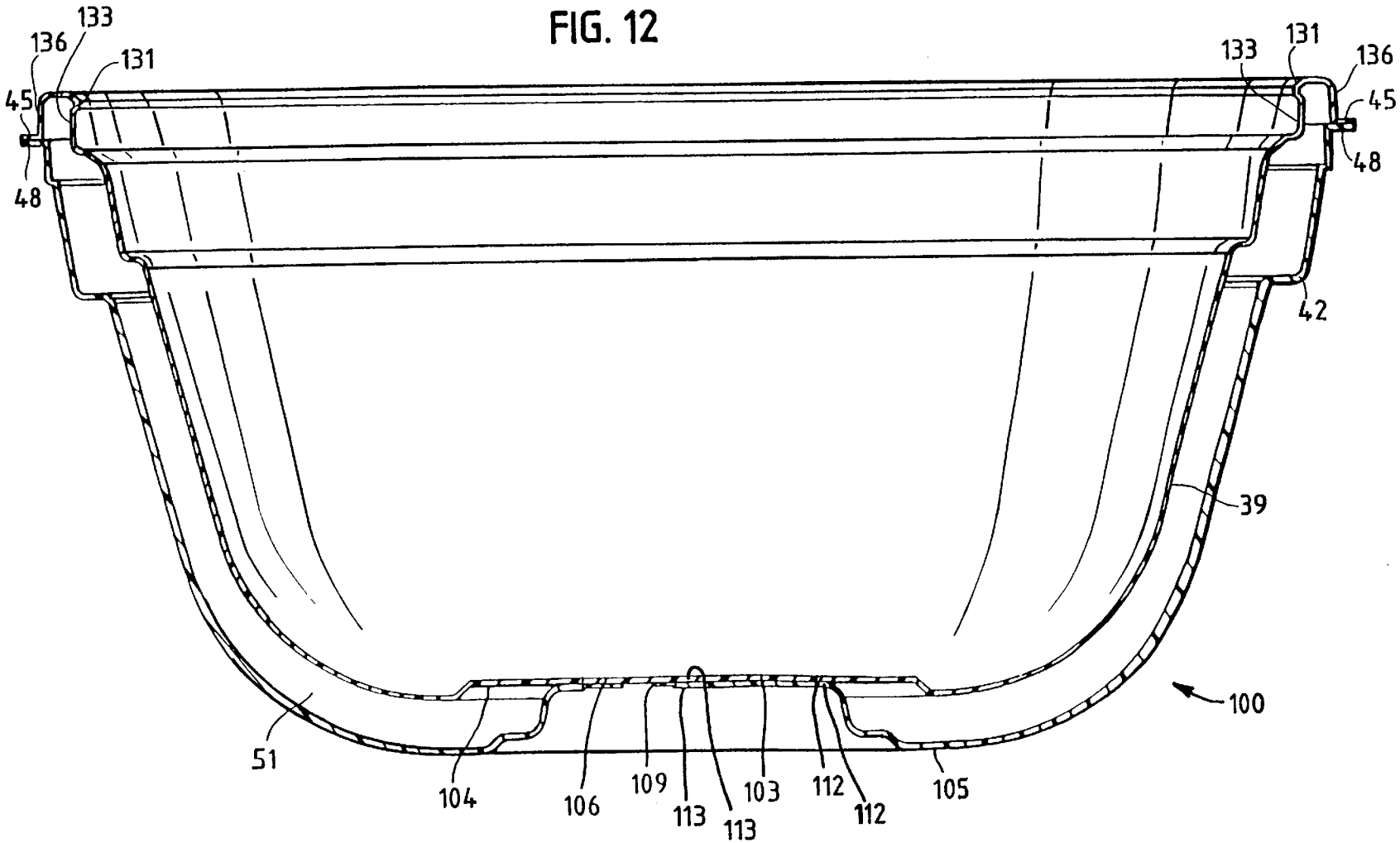
FIG. 12 is an enlarged sectional view taken along lines 12—12 of FIG. 11.
Figure 13:
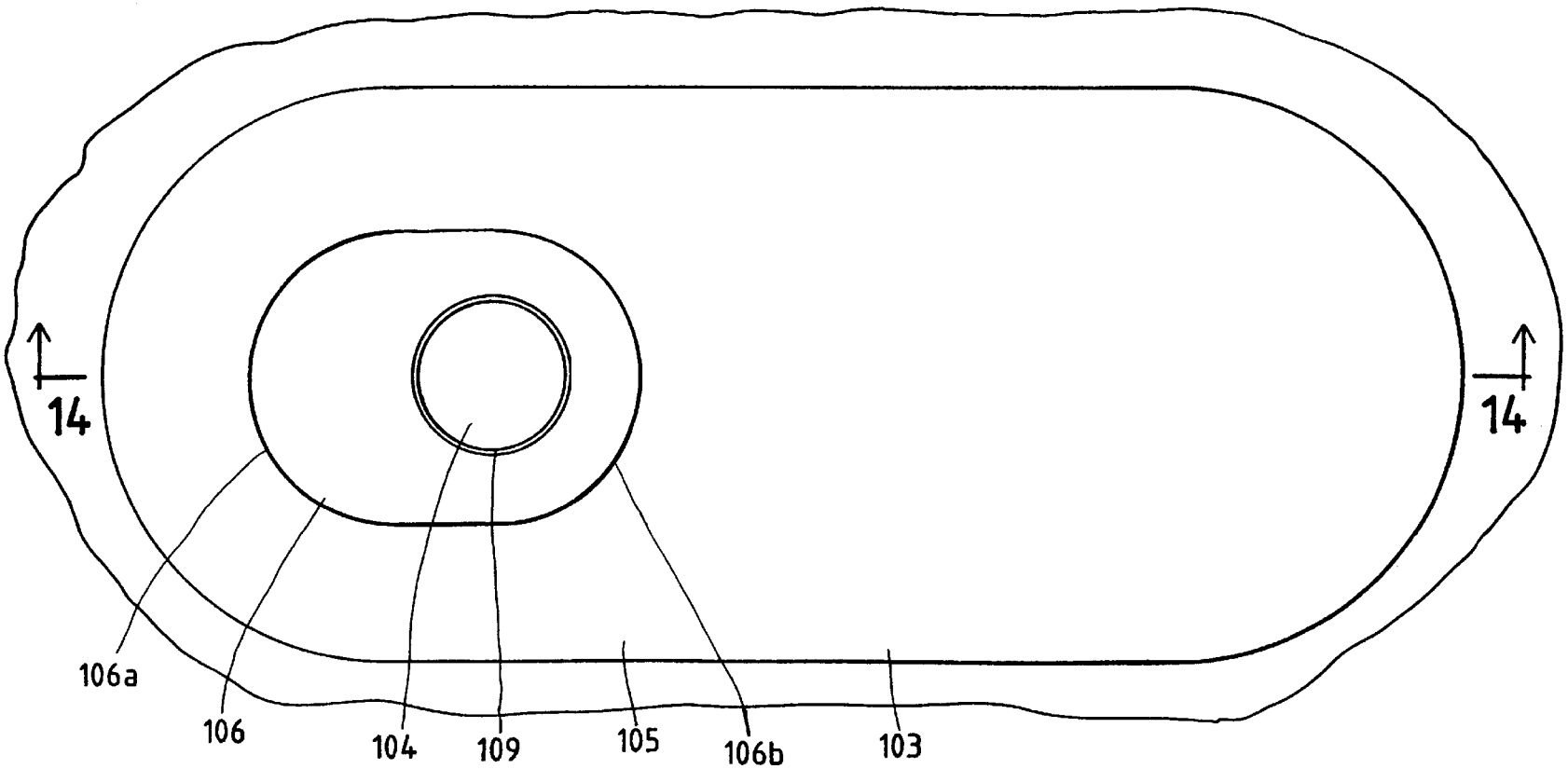
FIG. 13 is a fragmentary bottom view of the abutted section of the container of FIG. 11.
Figure 14:
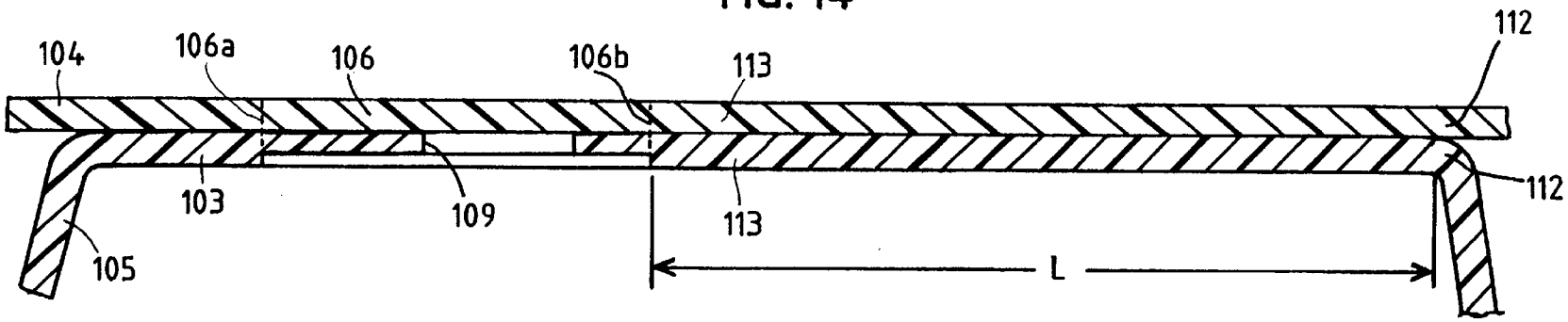
FIG. 14 is a sectional view taken along lines 14—14 of FIG. 13.
Figure 15:
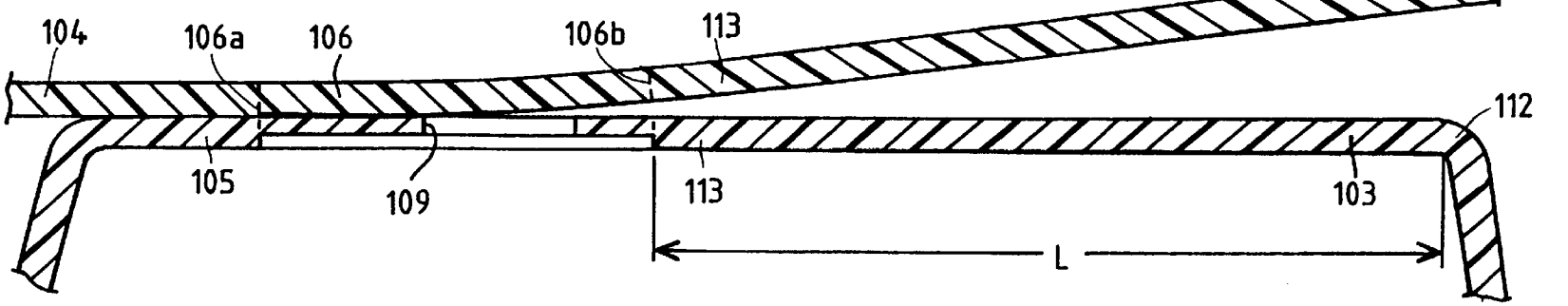
FIG. 15 is a view of the abutted section illustrating rupture of the weld.

The joined section 60 is replaced by an abutted section 103 having a first base portion 104 and a second base portion 105 (FIG. 12). The abutted section 103 includes a welded portion 106 that joins the base portions 104 and 105 together. Unlike previous embodiments, the base portions 104 and 105 are joined only at the welded portion 106 between margins 106*a* and 106*b* (shown as dashed lines in FIG. 14), while the remainder of the base portions 104 and 105 are simply in abutment. As seen in FIGS. 14 and 15, the welded portion 106 is disposed off-center of the abutted section 103. Upon exposure to an elevated pressure, the base portions 104 and 105 separate from one another such that the opening 109 is exposed to the ambient surroundings, thereby limiting pressure within the cavity 51.

It is believed that placing the welded portion 106 off-center on the abutted section 103 effectively facilitates rupture or peeling apart of the welded portion 106 more so than if the welded portion 106 were centered. For example, separation forces exerted at distal points 112 have longer moment arms L than separation forces developed at more proximal points 113. It is believed that these longer moment arms L are responsible for the more effective rupture of the welded portion 106 in response to elevated pressure within the cavity 51. Also, it is believed that placing the opening 109 closer to a point of peeling (i.e., the margin 106*b*) rather than the center of the welded portion 106 more effectively facilitates rupture.

A cross-linked gel is disposed in the cavity 51, similar to that used in the previous embodiments but having a somewhat different formulation. The paraben is replaced by about 0.1% by weight DOWICIDE A (an antimicrobial preservative sold by the Dow Chemical Company). Also, about 0.1% by weight propionic acid is added. Adding the DOWICIDE A tends to decrease the solid strength of the gel and also makes the gel somewhat alkaline. Adding the propionic acid counters these effects, increasing the solid strength of the gel sufficiently to ensure that the resulting gel is not pourable or flowable and reducing the pH to substantially neutral.

Assembly of the embodiment of FIGS. 11–20 is similar to the assembly described above and includes the following steps. The components of the gel are mixed together at room temperature. Prior to curing of the gel, while the gel is still in a substantially liquid state, the gel is poured into the second container portion 42. The first container portion 39 is placed within the second container portion 42, thereby displacing the gel upwardly along the walls of the portions 39 and 42 defining the cavity 51. Either before or after curing of the gel, the welded portion 106 is formed in the abutted section 103 by vibration welding. Shortly thereafter, the base portion 105 is drilled or cut between the margins 106*a* and 106*b* to form the opening 109 within the welded portion 106. Simultaneously, the rims 45 and 48 are also joined together by vibration welding to seal the cavity 51. Within several hours, the gel cures such that it assumes a generally solid structure.

If desired, the steps of forming the welded portion 106 and of welding the rims 45 and 48 could be performed sequentially, with either step being undertaken before the other. Also, the step of forming the opening 109 could be performed before or after either of the foregoing steps.

Figure 16:
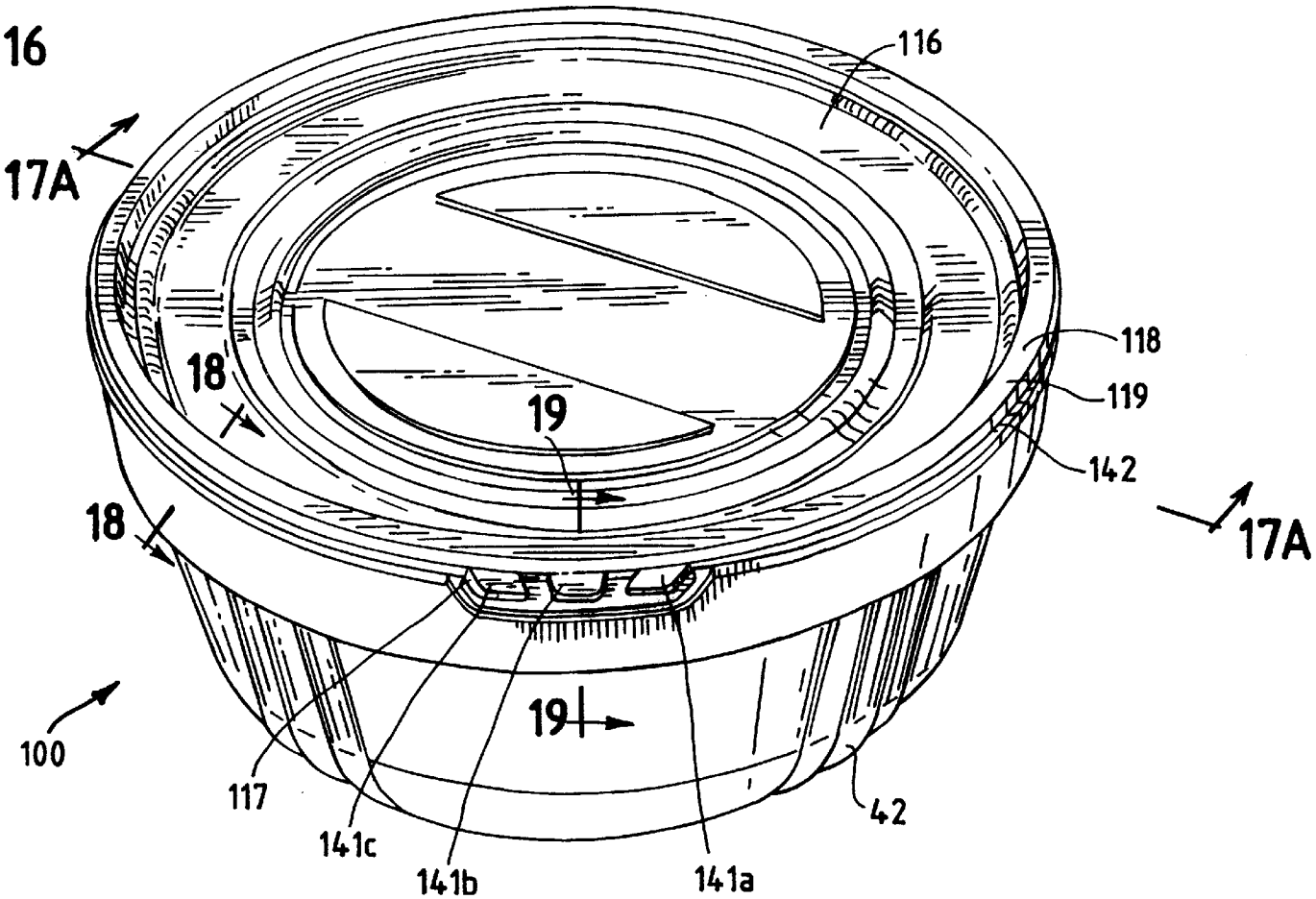
FIG. 16 is an isometric view of a lid disposed on the container of FIG. 11 looking down from above.

Referring to FIG. 16, the lid 67 is replaced by a lid 116 having a tab 117 and an inverted U-shaped peripheral member 118 defining a channel 119 (FIGS. 16–20) that receives a container rim 122 when the lid 116 is disposed on the container 100. Referring to FIG. 18, the peripheral member 118 includes first and second beads 125 and 128 wherein the first bead 125 is disposed in interfering relationship with a moisture retention ridge 131. The ridge 131 is disposed on an inner wall 133 of the container rim 122 adjacent the interior space 37 and the first bead 125 contacts the inner wall 133 below the moisture retention ridge 131 about the entire periphery of the container 100. The second bead 128 contacts an exterior or outer wall 136 in a discontinuous fashion, as noted in greater detail hereinafter. If desired, the ridge 131 could be placed on the outer wall 136 of the rim 122.

Figure 19:
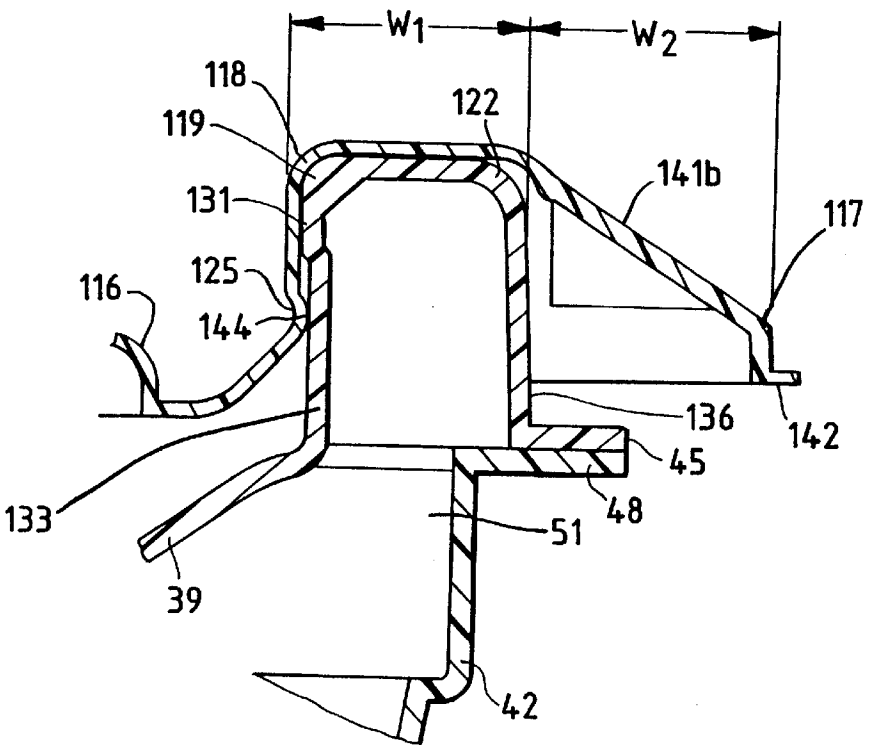
FIG. 19 is an enlarged fragmentary sectional view taken generally along lines 19—19 of FIG. 16.
Figure 20:
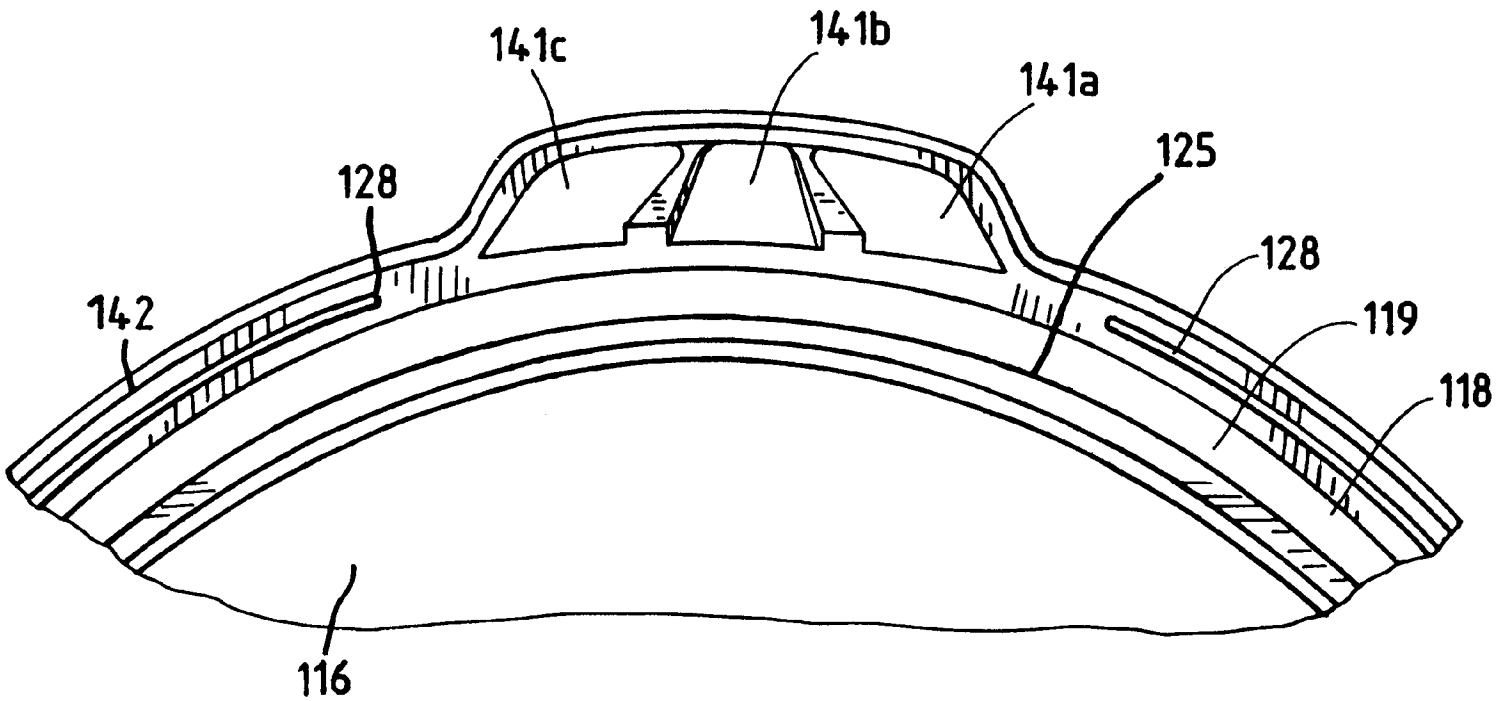
FIG. 20 is an enlarged fragmentary isometric bottom view of the bottom of the lid.

Referring to FIG. 19, the channel 119 of the lid 116 has a first width W1 that is approximately equal to a width W2 of the tab 117 (i.e., within about 0.02 inches). The tab 117 may be pulled upwardly by a user to remove the lid 116 from the container. The tab 117 is preferably substantially trapezoidal in shape and includes first through third raised stiffening ribs 141*a*–141*c* (FIG. 16). As seen in FIGS. 19 and 20, the bead 128 extends about only a portion of the periphery of the lid 116 so that the tab 117 and portions adjacent thereto interrupt the contact of the second bead 128 with the outer wall 136. The peripheral member 118 further includes a peripheral stiffening lip or flange 142 that further increases the rigidity of the tab 117 and the lid 116 as a whole. By incorporating the relatively short dimension W2 and the stiffening ribs 141, the tab 117 is sufficiently rigid and resistive to bending that it serves as an effective lever arm for removal of the lid 116.

Figure 17A:
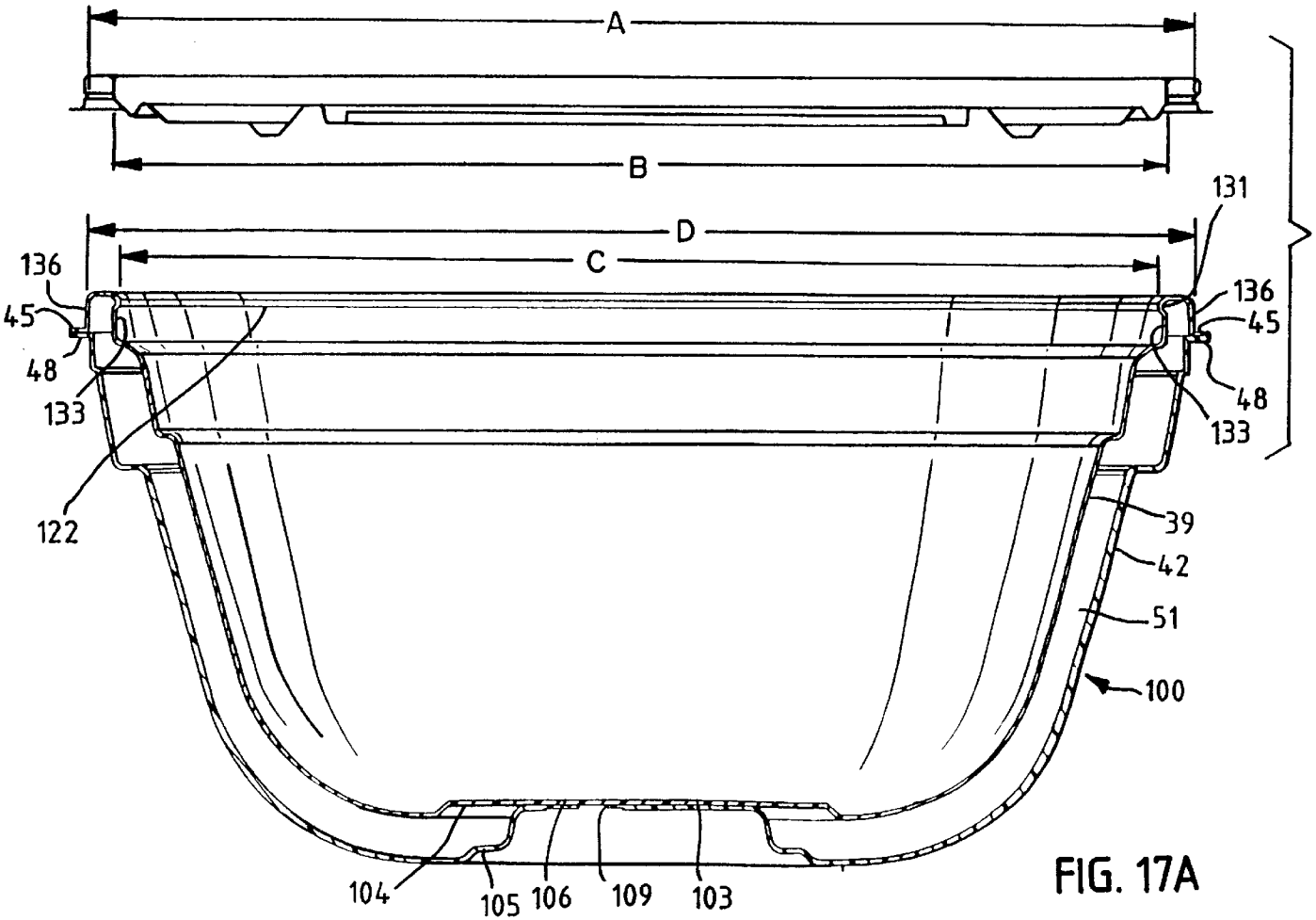
FIG. 17A is an exploded sectional view taken generally along lines 17A—17A of FIG. 16.
Figure 17B:
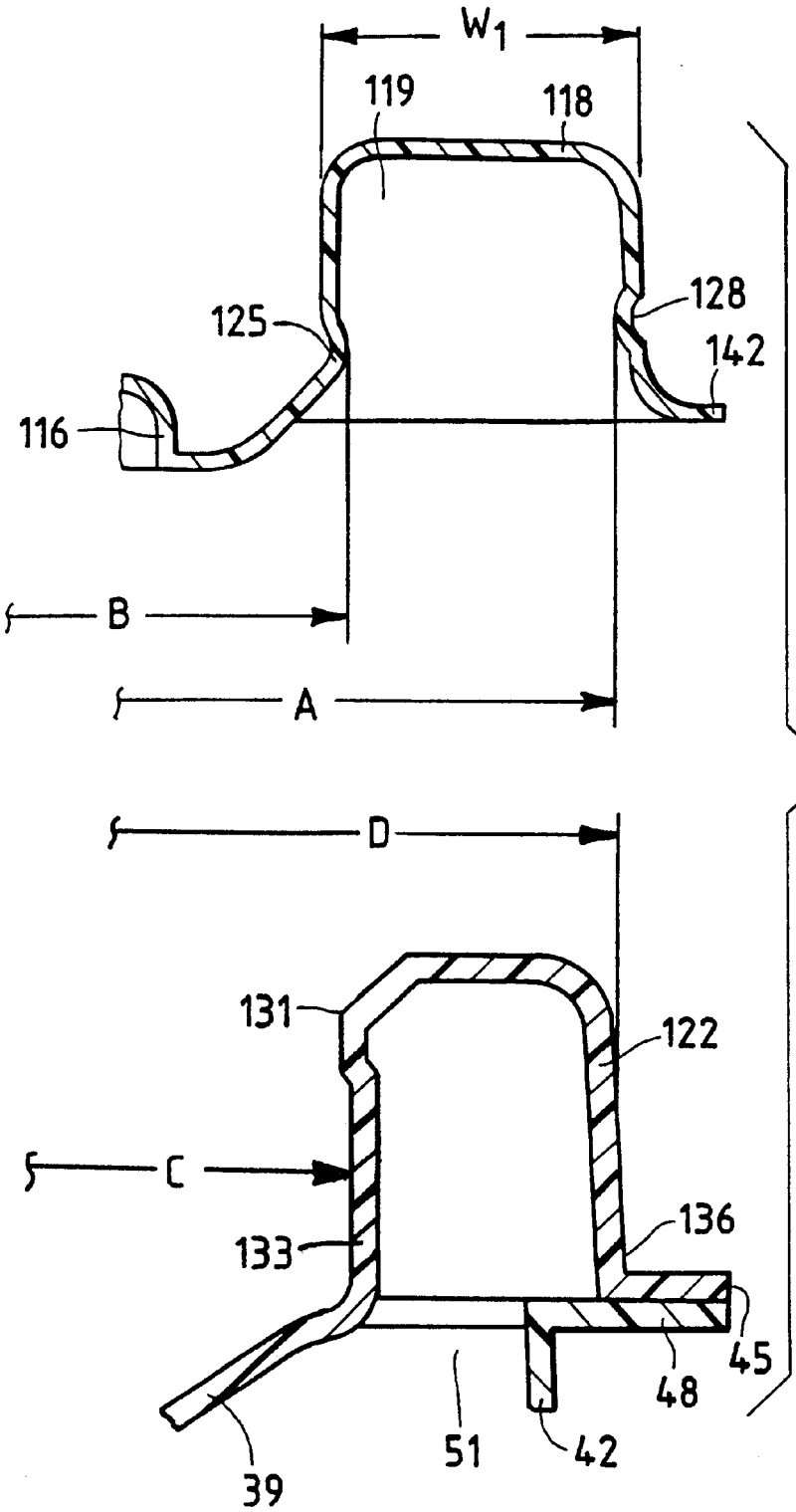
FIG. 17B is an exploded fragmentary sectional view of a portion of the container and lid of FIG. 17A further illustrating dimensions thereof.
Figure 18:
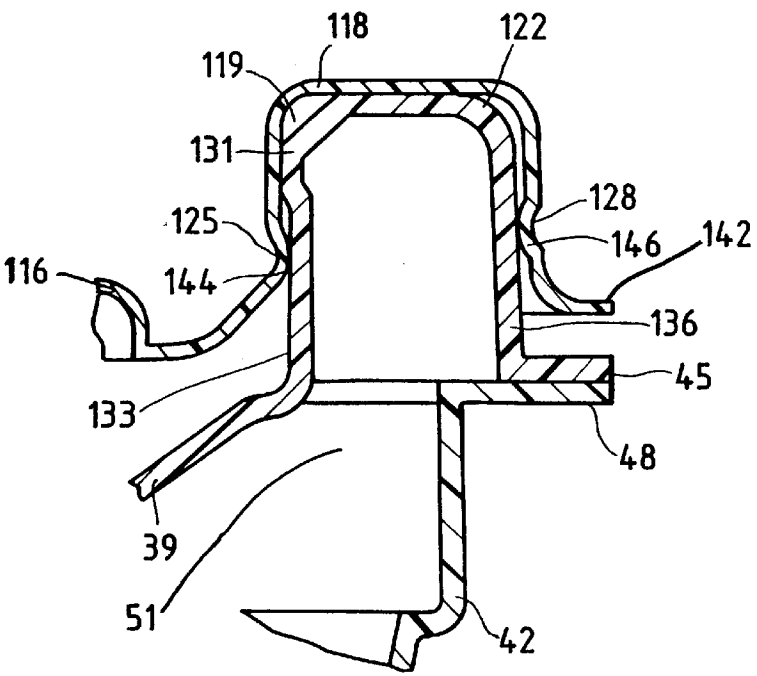
FIG. 18 is an enlarged fragmentary sectional view taken generally along lines 18—18 of FIG. 16.

FIGS. 17A and 17B show a dimension A measured at diametrically opposite points of the second bead 128, a dimension B measured at diametrically opposite points of the first bead 125, a dimension C measured at diametrically opposite points of the inner wall 133, and a dimension D measured at diametrically opposite points of the outer wall 136. Referring also to FIG. 18, a first seal 144 is defined by the first bead 125 and the wall 133. The first seal 144 may be described as a B-C interference fit, dimension B being greater than dimension C, such that the material of the peripheral member 118 flexes when the lid 116 is placed on the container 100 so that the lid 116 is retained on the container 100.

The water component of the gel is capable of assuming first and second phases. For example, the water is in the liquid phase at room temperature and the solid phase when frozen. When the water freezes, the gel expands within the cavity 51 causing the wall 133 to move toward the interior space 37 somewhat, thereby reducing dimension C and creating an increased B-C interference fit. For this reason, a nominal B-C interference is selected that is sufficiently small (or loose) at room temperature so that the B-C interference does not become overly tight when dimension C is reduced. At the same time, it would be desirable to select a nominal B-C interference that is sufficiently large to provide adequate sealing at room temperature.

However, while it is possible to select a nominal B-C interference capable of satisfying the above conditions simultaneously, there is typically some deviation below nominal due to manufacturing variations (e.g., due to tolerances) such that the first seal 144 (i.e., the B-C interference) is too loose and does not provide adequate sealing at room temperature for certain combinations of containers and lids. An A-D interference (or second seal 146 seen in FIG. 18) is provided that ensures adequate sealing in instances when the actual B-C interference is below nominal. This is because the magnitude of the actual A-D interference tends to deviate above nominal (the nominal A-D interference being 0) when the actual B-C interference deviates below nominal. (Dimension A tends to decrease with dimension B when dimension B decreases below nominal.) In this regard, the A-D interference tends to compensate for inadequate sealing of the B-C interference in instances where the combination of lid and container has an actual B-C interference below the nominal value thereof. In addition, dimension D tends to increase when dimension C increases above nominal; this also tends to provide a greater actual A-D interference when the actual B-C interference is below nominal.

By way of example, and not as a limitation, the foregoing values have the nominal dimensions noted below at room temperature (all dimensions are in inches):

| Reference Letter | Nominal Dimension |
|---|---|
| A | 8.474 |
| B | 7.975 |
| C | 7.952 |
| D | 8.474 |
| W1 | 0.310 |
| W2 | 0.328 |

As noted above, when the water component of the gel freezes, dimension C is reduced. For example, in a container having the above dimensions, dimension C is reduced from 7.952 inches to about 7.942 inches (i.e., about 0.010 inches), thereby increasing the B-C interference.

Industrial Applicability

The container and lid of the present invention provide improved sealing and lid removal characteristics. Improved protection against sudden rupture of the container in the event of placement of the container in a microwave oven is also provided.

If desired, the round container and lid of FIGS. 11–20 may instead have the substantially square configuration of FIG. 10 or any other configuration.

Numerous modifications to the present invention will be apparent to those skilled in the art in view of the foregoing description. Accordingly, this description is to be construed as exemplary of the claimed invention and is presented for the purpose of enabling those skilled in the art to make and use the invention and to teach the best mode of carrying out same. The exclusive rights to all modifications which come within the scope of the appended claims are reserved.

We claim:

1. A container, comprising:

a sealed cavity defined by first and second walls of the container;

a coolant disposed within the cavity wherein the coolant is capable of assuming first and second phases;

a portion of the first wall being joined to the second wall wherein the portion includes an off-center opening and wherein the portion is rupturable to limit pressure in the sealed cavity;

a container rim; and a lid having an outer channel and a tab wherein the outer channel receives the container rim and defines a first width and wherein the tab has a second width substantially equal to the first width;

wherein a first interference fit is established between the channel and the container rim when the coolant is in the first phase and a second interference fit different than the first interference fit is established when the coolant is in the second phase.

2. The container of claim 1, wherein the coolant is a cross-linked gel.

3. The container of claim 1, wherein the portion is joined to the second wall by vibration welding.

4. The container of claim 1, wherein the tab includes a stiffening rib.

5. The container of claim 1, wherein the second phase comprises freezing of a water component of the coolant and wherein the first interference fit comprises a bead disposed in the channel wherein the bead forms a greater interference fit with the container rim when the coolant is in the second phase.

6. The container of claim 1, wherein the container rim comprises a moisture retention ridge.

7. A method of manufacturing a container, the method comprising the steps of:

providing first and second container portions;

placing a coolant in the second container portion;

placing the first container portion within the second container portion thereby defining a sealed cavity between the portions;

joining a region of the second container portion to the first container portion; and forming an opening in at least one of the container portions in the region;

wherein the opening is separable from the region in response to a pressure increase in the sealed cavity to vent the pressure increase to ambient surroundings.

8. The method of claim 7, wherein the coolant is a cross-linked gel.

9. The method of claim 7, wherein the first and second parts are joined by vibration welding.

10. The method of claim 7, wherein the opening is formed prior to welding the first and second parts.

11. The method of claim 7, wherein the opening is formed subsequent to welding the first and second parts.

12. A method of manufacturing a container, the method comprising the steps of:

providing a coolant within the container wherein the coolant is capable of assuming first and second phases;

providing a lid that forms first and second seals with the container; and selecting a nominal interference for the first seal effective when the container is exposed to a particular condition;

wherein the second seal ensures sealing of the lid with the container when the container is exposed to a condition other than the particular condition.

13. The method of claim 12, wherein the coolant comprises a cross-linked gel.

14. The method of claim 13, wherein the cross-linked gel comprises water and the water is capable of assuming first and second phases.

15. The method of claim 14, wherein the first seal comprises a bead in sealing engagement with an inner wall of a rim of the container.

16. The method of claim 15, wherein the second seal comprises a second bead in sealing engagement with an outer wall of a rim of the container.

17. A container, comprising:

a container body including a hollow cavity and a rim;

a coolant within the hollow cavity wherein the coolant is capable of assuming first and second phases; and a lid having a peripheral member wherein the peripheral member forms first and second seals with the rim and wherein the seals have different interference fits with the rim when the container is exposed to different temperatures.

18. The container of claim 17, wherein the coolant comprises a cross-linked gel.

19. The container of claim 17, wherein the cross-linked gel includes water.

20. The container of claim 17, wherein the first seal comprises a bead in sealing engagement with a rim of the container.

21. A lid for a container, comprising:

a peripheral member defining an outer channel, the peripheral member having a peripheral wall that carries a bead wherein the bead contacts a rim of the container; and a tab extending from the peripheral wall that interrupts contact of the bead with the rim;

the outer channel having a first width and the tab having a second width substantially equal to the first width.

22. The lid of claim 21, wherein the container is a cooling container.

23. The lid of claim 22, wherein the tab is substantially trapezoidal in shape.

24. The lid of claim 22, wherein the tab includes a stiffening lip disposed about a periphery thereof.

25. The lid of claim 22, wherein the tab includes at least one stiffening rib.

26. The lid of claim 22, wherein the tab includes three stiffening ribs.

27. A lid for a container, comprising:

an outer channel of a first width; and a tab extending outwardly from the channel wherein the tab has a second width substantially equal to the first width.

28. The lid of claim 27, wherein the container is a cooling container.

29. The lid of claim 28, wherein the tab is substantially trapezoidal in shape.

30. The lid of claim 29, wherein the tab includes a stiffening lip about a periphery thereof.

31. The lid of claim 30, wherein the tab includes at least one stiffening rib.

32. The lid of claim 30, wherein the tab includes three stiffening ribs.

33. A lid for a container, comprising:

an outer channel defined by a peripheral wall that carries a bead wherein the bead contacts a rim of the container; and a tab extending outwardly from the peripheral wall wherein the tab interrupts contact of the bead with the rim.

34. The lid of claim 33, wherein the container is a cooling container.

35. The lid of claim 34, wherein the tab is substantially trapezoidal in shape.

36. The lid of claim 35 wherein the tab includes a stiffening lip about a periphery thereof.

37. The lid of claim 36, wherein the tab includes at least one stiffening rib.

38. The lid of claim 36, wherein the tab includes three stiffening ribs.

39. The lid of claim 12, wherein the particular condition is exposure to a room temperature environment.

* * * * *